US012435406B2

(12) United States Patent
Ernst et al.

(10) Patent No.: US 12,435,406 B2
(45) Date of Patent: Oct. 7, 2025

(54) ACTIVATION OF SELF-PASSIVATING METALS USING REAGENT COATINGS FOR LOW TEMPERATURE NITROCARBURIZATION IN THE PRESENCE OF OXYGEN-CONTAINING GAS

(71) Applicants: Swagelok Company, Solon, OH (US); Case Western Reserve University, Cleveland, OH (US)

(72) Inventors: Frank Ernst, Cleveland Heights, OH (US); Todd Johns, Solon, OH (US); Ronald Edmonson, Munroe Falls, OH (US); Cyprian Adair William Illing, Cleveland Heights, OH (US); Peter C. Williams, Cleveland Heights, OH (US); Christina Semkow, University Heights, OH (US)

(73) Assignee: SWAGELOK COMPANY, Solon, OH (US)

( * ) Notice: Subject to any disclaimer, the term of this patent is extended or adjusted under 35 U.S.C. 154(b) by 567 days.

(21) Appl. No.: 17/731,437

(22) Filed: Apr. 28, 2022

(65) Prior Publication Data

US 2022/0364216 A1 Nov. 17, 2022

Related U.S. Application Data

(60) Provisional application No. 63/180,744, filed on Apr. 28, 2021.

(51) Int. Cl.

| | |
|---|---|
| ***C23C 8/22*** | (2006.01) |
| ***C23C 8/26*** | (2006.01) |
| ***C23C 8/32*** | (2006.01) |

(52) U.S. Cl.

CPC ..... *C23C 8/22* (2013.01); *C23C 8/26* (2013.01); *C23C 8/32* (2013.01)

(58) Field of Classification Search

CPC .... C23C 8/20; C23C 8/22; C23C 8/24; C23C 8/26; C23C 8/30; C23C 8/32; C23C 18/02; C21D 1/06

See application file for complete search history.

(56) References Cited

U.S. PATENT DOCUMENTS

| | | | |
|---|---|---|---|
| 2,789,930 | A | 4/1957 | Englehard |
| 3,232,797 | A | 2/1966 | Bessen |
| 4,036,482 | A | 7/1977 | Kieferle |
| 4,844,949 | A | 7/1989 | Arai |
| 5,014,646 | A | 5/1991 | Ito et al. |
| 5,443,662 | A | 8/1995 | Arai et al. |
| 5,556,483 | A | 9/1996 | Masaaki et al. |
| 5,593,510 | A | 1/1997 | Masaaki et al. |
| 5,745,834 | A | 4/1998 | Bampton |
| 5,792,282 | A | 8/1998 | Masaaki et al. |
| 6,093,303 | A | 7/2000 | Williams et al. |
| 6,165,597 | A | 12/2000 | Williams et al. |
| 6,547,888 | B1 | 4/2003 | Williams et al. |
| 8,414,710 | B2 | 4/2013 | Minemura et al. |
| 8,784,576 | B2 | 7/2014 | Somers |
| 8,845,823 | B2 | 9/2014 | Christiansen et al. |
| 9,738,962 | B2 | 8/2017 | Bremer et al. |
| 10,214,805 | B2 | 2/2019 | Williams et al. |
| 10,604,832 | B2 | 3/2020 | Williams |
| 11,193,197 | B2 | 12/2021 | Illing |
| 11,473,183 | B2 | 10/2022 | Williams |
| 11,649,538 | B2 | 5/2023 | Illing |
| 2002/0014281 | A1 | 2/2002 | Heishi |
| 2004/0175407 | A1 | 9/2004 | McDaniel |
| 2006/0090817 | A1 | 5/2006 | Somers et al. |
| 2011/0123907 | A1 | 5/2011 | Yau |
| 2012/0111456 | A1 | 5/2012 | Christianson et al. |
| 2013/0136868 | A1 | 5/2013 | Bruck et al. |
| 2013/0240090 | A1 | 9/2013 | Watanabe |
| 2016/0032442 | A1 | 2/2016 | Williams et al. |
| 2016/0298203 | A1 | 10/2016 | Hackel |
| 2017/0165791 | A1 | 6/2017 | Kamachi |
| 2017/0166986 | A1 | 6/2017 | Schiroky |
| 2018/0119239 | A1 | 5/2018 | Tuffile |
| 2019/0376173 | A1 | 12/2019 | Illing |
| 2020/0283882 | A1 | 9/2020 | Williams |
| 2021/0134065 | A1 | 5/2021 | Ramani et al. |
| 2021/0172046 | A1 | 6/2021 | Illing et al. |
| 2021/0340659 | A1 | 11/2021 | Semkow |
| 2022/0064778 | A1 | 3/2022 | Illing |
| 2022/0072618 | A1 | 3/2022 | Illing |

(Continued)

FOREIGN PATENT DOCUMENTS

| | | |
|---|---|---|
| CN | 1067929 | 1/1993 |
| CN | 102828145 | 12/2012 |
| CN | 103215536 | 7/2013 |

(Continued)

OTHER PUBLICATIONS

Joseph R. Davis et al., ASM International, Materials Park, Ohio, Heat Treating: "Gas Carburizing", pp. 312-324, Aug. 1991.*

Bond, "The role of carbon deposits in metal-catalysed reactions of hydrocarbons", Applied Catalysis A: General., vol. 149, No. 1, pp. 3-25, Jan. 1997.

Johnson et al., "Chemisorption and thermal decomposition of methylamine on the ruthenium (001) surface", J. Am. Chem. Soc. vol. 114, No. 11, pp. 4279-0490, May 1992.

Kuncicka et al. "Advances in metals and alloys for joint replacement", Progress in Materials Science, 88, pp. 232-280, 2017.

Schaber et al. "Thermal decomposition (pyrolysis) of urea in an open reaction vessel", Thermochimica Acta. 424, pp. 131-142 (2004).

(Continued)

*Primary Examiner* — Jessee R Roe

(74) *Attorney, Agent, or Firm* — Calfee, Halter & Griswold LLP

(57) ABSTRACT

A method for low-temperature interstitial case formation on a self-passivating metal workpiece includes exposing the workpiece in a heated gaseous environment comprising oxygen to pyrolysis products of a nonpolymeric reagent comprising nitrogen and carbon.

21 Claims, 1 Drawing Sheet

(56) References Cited

U.S. PATENT DOCUMENTS

2023/0015135 A1 1/2023 Williams

FOREIGN PATENT DOCUMENTS

| | | | |
|---|---|---|---|
| CN | 103314132 | | 9/2013 |
| CN | 105328185 | | 2/2016 |
| DE | 4342730 | | 6/1995 |
| EP | 516899 | | 12/1992 |
| EP | 787817 | | 8/1997 |
| EP | 2278038 | | 1/2011 |
| GB | 1023337 | | 3/1966 |
| JP | S50-109827 | | 8/1975 |
| JP | S52128847 | | 10/1977 |
| JP | H05-202464 | | 8/1993 |
| JP | H08-104972 | | 4/1996 |
| JP | 9-071853 | A | 3/1997 |
| JP | 9-268364 | A | 10/1997 |
| JP | 2005-232518 | | 9/2005 |
| JP | 2005-532471 | | 12/2005 |
| JP | 2009-517542 | | 4/2009 |
| SU | 1687645 | | 10/1991 |
| WO | 2006/136166 | A1 | 12/2006 |
| WO | 2011/009463 | A1 | 1/2011 |
| WO | 2015066320 | | 5/2015 |
| WO | 2016/027042 | A1 | 2/2016 |
| WO | 2019/241011 | A1 | 12/2019 |

OTHER PUBLICATIONS

Schneider, et al. Introduction to Surface Hardening of Steels, ASM Handbook, vol. 4A, Steel Heat Treating Fundamentals and Processes, copyright 2013, pp. 389-398.
Stag Melissen et al., "DFT Perspective on the Thermochemistry of Carbon Nitride Synthesis", J. of Physical Chemistry C. vol. 120, No. 43, pp. 24542-24550, Nov. 2016.
Zhu et al., "Graphitic Carbon Nitride: Synthesis, Properties, and Applications in Catalysis", ASC Applied Materials & Interfaces, vol. 6, No. 19, pp. 16449-16465, Oct. 2014.
International Search Report and Written Opinion from PCT/US2015/042785 dated Oct. 28, 2015.
International Search Report and Written Opinion from PCT/US19/035694 dated Aug. 2, 2019.
International Search Report from PCT/US2020/063284 dated Apr. 13, 2021.
International Search Report and Written Opinion from PCT/US2021/029541 dated Aug. 5, 2021.
International Search Report and Written Opinion from PCT/US2021/049600 dated May 19, 2022.
Notice of Allowance from U.S. Appl. No. 14/813,290 dated Oct. 17, 2018.
Office action from U.S. Appl. No. 16/433,083 dated Apr. 21, 2021.
Notice of Allowance from U.S. Appl. No. 16/433,083 dated Aug. 4, 2021.
Office action from U.S. Appl. No. 16/832,253 dated Mar. 9, 2022.
Notice of Allowance from U.S. Appl. No. 16/832,253 dated Jun. 20, 2022.
Office action from U.S. Appl. No. 17/242,555 dated Mar. 13, 2023.
Notice of Allowance form U.S. Appl. No. 17/242,555 dated Jun. 22, 2023.
Office action from U.S. Appl. No. 17/112,076 dated Nov. 30, 2022.
Office action from U.S. Appl. No. 17/112,076 dated May 5, 2023.
Office action from U.S. Appl. No. 17/470,287 dated Mar. 3, 2023.
Office action from U.S. Appl. No. 17/524,031 dated Aug. 6, 2022.
Notice of Allowance from U.S. Appl. No. 17/524,031 dated Dec. 12, 2022.
Office action from Chinese Application No. 201580040222.9 dated Aug. 14, 2018.
Office action from Chinese Application No. 202011268560.7 dated Aug. 10, 2022.
Search Report from European Application No. 15828180.8 dated Feb. 20, 2018.
Communication from European Application No. 22177892.1 dated Oct. 11, 2022.
Office action from Japanese Application No. 2020-567961 dated May 23, 2023.
Office action from Japanese Application No. 2020-567961 dated Oct. 31, 2023.
Yari, "Nitriding for corrosion and wear fatigue resistance", 2020.
Office action from U.S. Appl. No. 17/470,287 dated Feb. 28, 2024.
International Search Report from PCT/US2023/067444 dated Aug. 21, 2023.
Office action from Japanese Application No. 2022-565720 dated Jul. 23, 2024.
Office action from U.S. Appl. No. 17/470,287 dated Aug. 14, 2024.
Ge et al. "The Effect of Surface Finish on Low-Temperature Acetylene-Based Carburization of 316L Austenitic Stainless Steel", Metallurgical and Materials Transactions B, vol. 458, Dec. 2014, pp. 2338-2345, copyright 2014.
Stickels, "Gas Carburizing", pp. 312-324, vol. 4, ASM Handbook, copyright 1991, ASM International.
Ren et al. "Electronic impact of concentrated interstitial carbon on physical properties of AISI-316 austenitic stainless steel", Acta Materialia, 173, pp. 96-105 (2019).
Ren et al. "Ultrahigh-strength AISI-316 austenitic stainless steel foils through concentrated interstitial carbon", Acta Materialia, 167, pp. 231-240 (2019).
Anh et al. "First-principles study of hydrogen-enhanced phosphorus diffusion in silicon", Journal of Applied Physics, 119, 8 pgs., (2016).
Agaponova, "Encapsulation Method for Surface Engineering of Corrosion-Resistant Alloys by Low-Temperature Nitro-Carburization", Dept. of Materials Science and Engineering, Case Western Reserve University, 140 pgs., Jan. 2016.
Palmer et al. "Preparation and Extraction of INsuluble (Inclusion-Body) Proteins from *Escherichia coli*", 1 pg., copyright 2000.
Guanidine HCl 6M—GMP Denaturant, Bio Pharma Grade, GH4120, CAS#50-01-1, 2 pgs., Apr. 25, 2021.
SilcoTek, "Impoving Corrosion Resistance in Biopharmaceuticals", one page, Apr. 25, 2021.
International Search Report from PCT/US2022/026640 dated Jun. 24, 2022.
Gu et al. "Numerical Simulations of Carbon and Nitrogen Composition Depth Profiles in Nitrocarburized Austenitic Stainless Steels", Metal. and Mater. Transactions A, 45A, pp. 4268-4279 (2014).
Edelmann, Chapter Two, "Recent Progress in the Chemistry of Metal Amidinates and Guanidinates: Syntheses, Catalysis and Materials", Advances in Organometallic Chemistry, vol. 61, p. 2 (Scheme 2.1) and p. 4 (Scheme 2.2), (2013). (submitted in two separate PDF's due to size limitation).

* cited by examiner

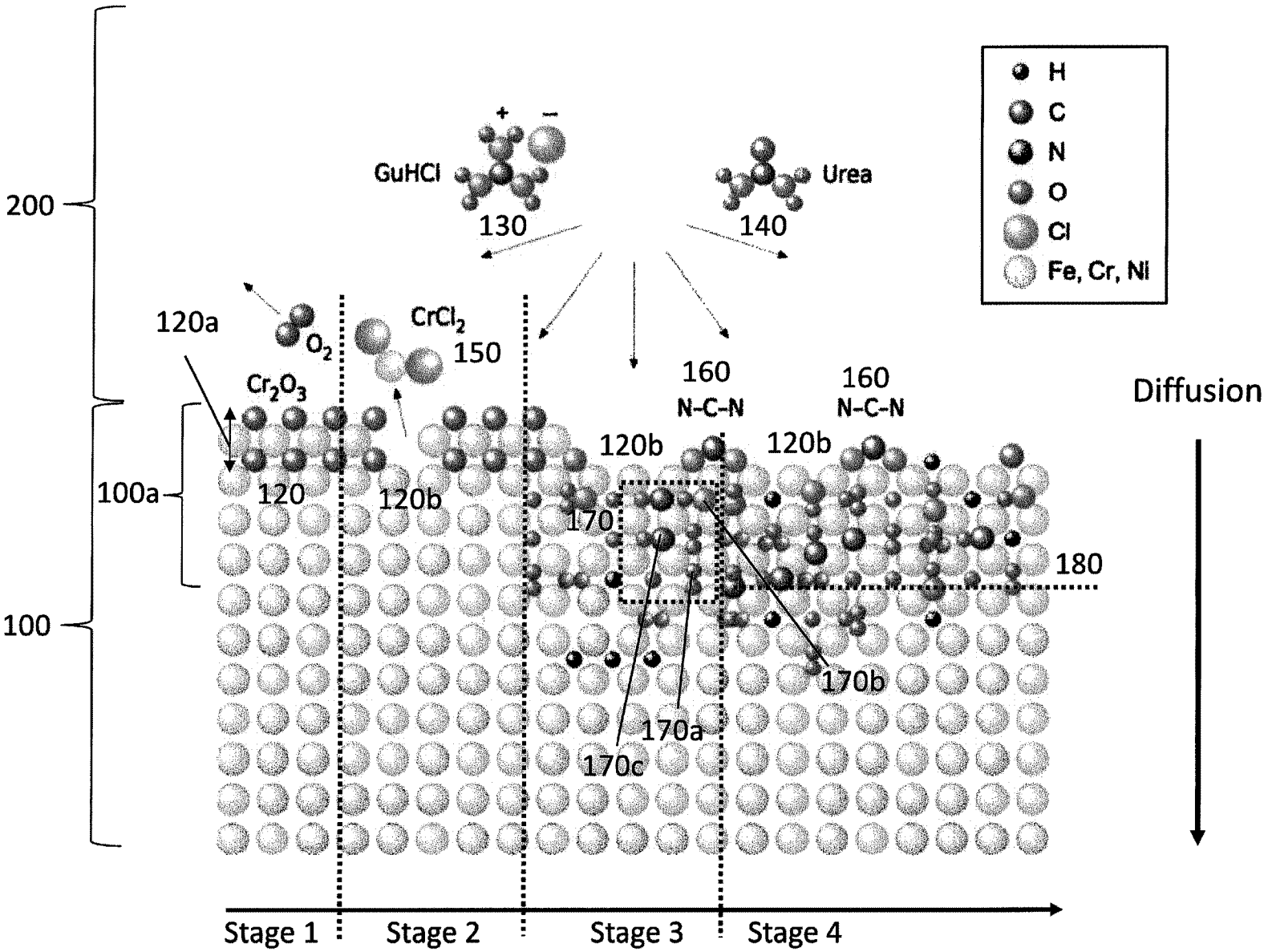
H
C
N
O
Cl
Fe, Cr, Ni
Diffusion
Urea
140
GuHCl
130
160
N-C-N
120b
160
N-C-N
120b
180
170b
170a
170c
170
CrCl2
150
120b
O2
Cr2O3
120
120a
100a
Stage 1
Stage 2
Stage 3
Stage 4
200
100

ACTIVATION OF SELF-PASSIVATING METALS USING REAGENT COATINGS FOR LOW TEMPERATURE NITROCARBURIZATION IN THE PRESENCE OF OXYGEN-CONTAINING GAS

CROSS-REFERENCE TO RELATED APPLICATION

This application claims the benefit of U.S. Provisional Patent Application Ser. No. 63/180,744, filed Apr. 28, 2021 entitled "ACTIVATION OF SELF-PASSIVATING METALS USING REAGENT COATINGS FOR LOW TEMPERATURE NITROCARBURIZATION IN THE PRESENCE OF OXYGEN-CONTAINING GAS," the priority of which is hereby claimed and the disclosure of which is incorporated herein by reference in its entirety.

FIELD

This disclosure relates to metal working and metal preparation. It relates to treatments of metal surfaces to improve properties, including hardness and corrosion resistance. It also relates to coatings used to apply or block the application of reagents to metal surfaces. The reagents may assist in case formation, for example, by activating and/or hardening the metal surfaces, where the hardening occurs via carburization, nitriding, nitrocarburization, and carbonitriding.

BACKGROUND

Conventional Carburization

Conventional (high temperature) carburization is a widely used industrial process for enhancing the surface hardness of shaped metal articles ("case hardening"). In a typical commercial process, the workpiece or article (herein the terms "workpiece" and "article" are used interchangeably) is contacted with a carbon-containing gas at elevated temperature (e.g., 1,000° C. or more) whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, ASM Handbook, © 1991, ASM International.

Stainless steel is corrosion-resistant because the chromium-rich oxide film that immediately forms on the surface when the steel is exposed to air is impervious to the transmission of water vapor, oxygen and other chemicals. Nickel-based, cobalt-based, manganese-based and other alloys containing significant amounts of chromium, typically 10 wt. % or more, also form these impervious chromium oxide coatings. Other alloys exhibit a similar phenomenon in that they also immediately form oxide films when exposed to air which are also impervious to the transmission of water vapor, oxygen and other chemicals.

These alloys are said to be self-passivating, not only because they form oxide surface coatings immediately upon exposure to air, but also because these oxide coatings are impervious to the transmission of water vapor, oxygen, and other atom species. These films are fundamentally different from e.g., the iron oxide (rust) that forms when iron or other low-alloy steels are exposed to air. This is because these iron oxide scales are not impervious to the transmission of water vapor, oxygen and other chemicals, as can be appreciated by the fact that these alloys can be completely consumed by rust if not suitably protected.

Traditionally, when stainless steel needs to be carburized to levels above the (very small) solubility limit of carbon at ≈500° C., the temperature above which the diffusional mobility of Fe, Cr, and Ni becomes notable, this is carried out at high temperature in order to enable rapid transport of carbon and because the equilibrium solubility limit of carbon increases rapidly (exponentially) with the absolute temperature. Under these conditions, however, the solubility limit may be exceeded during cooling, resulting in precipitation of chromium-rich carbide particles. As these precipitates, forming under near-equilibrium conditions, are rather large, correspondingly large regions of, the steel matrix between the precipitates are locally depleted of chromium. As a result, there are extended surface regions unable to form the passivating chromium-rich oxide film. Since this compromises the corrosion resistance, stainless steel is rarely case-hardened by conventional carburization, although the hardening by carbide precipitates can be considerable.

Low-Temperature Carburization

In the mid 1980's, a technique for case hardening stainless steel was developed in which the workpiece is contacted with a carbon-containing gas at low temperature, typically below ≈500° C. At these temperatures, and provided that carburization does not last too long, carbon atoms liberated by decomposition of the gas diffuse into the workpiece surface, typically to a depth of ≈10 μm in ≈20 hours. While the atom fraction of carbon can largely exceed the equilibrium solubility limit of carbon at ≈500° C., carbide precipitates do not form because at processing temperatures ≈500° C., the mobility of Fe, Cr, Ni is too small to form such precipitates within the processing time. Nonetheless, a hard case (shell-like subsurface zone) is obtained. Because carbon forms local interatomic bonds with Cr, Fe, Ni, the corrosion resistance of the steel is not only unimpaired, but dramatically improved (although the passivating film on carburized stainless steel was observed to be thinner/less developed than on non-carburized steel). This technique, which is referred to a "low-temperature carburization," is described in a number of publications including U.S. Pat. Nos. 5,556,483, 5,593,510, 5,792,282, 6,165,597, EPO 0787817, Japan 9-14019 (Kokai 9-268364) and Japan 9-71853 (Kokai 9-71853).

Nitriding and Carbonitriding

In addition to carburization, nitriding and carbonitriding can be used to surface harden various alloys. Nitriding works the same way as carburization except that, rather than using a carbon-containing gas that decomposes to yield carbon atoms diffusing into the alloy, nitriding uses a nitrogen containing gas which decomposes to yield nitrogen atoms diffusing into the alloy.

In the same way as carburization, however, if nitriding is accomplished at higher temperatures and without rapid quenching, hardening mainly occurs through the formation and precipitation of discrete compounds of the diffusing atoms, i.e., nitrides. On the other hand, if nitriding is accomplished at lower temperatures, significant hardening occurs without formation of precipitates, likely mostly through localized interatomic bonding between nitrogen atoms and their metal atom neighbors. As in the case of carburization, stainless steels are not normally nitrided by conventional (high-temperature) or plasma nitriding because the corrosion resistance is lost when precipitation of coarse chromium-rich nitride particles under near-equilibrium conditions depletes extended surface regions of the chromium needed to form the passivating film.

In nitrocarburization, which is also referred to as carbonitriding, the workpiece is exposed to both nitrogen and carbon-containing gases, whereby both nitrogen atoms and carbon atoms diffuse into the workpiece for surface hardening. In the same way as carburization and nitriding, nitrocarburization or carbonitriding can be accomplished at high temperatures, in which case hardening occurs through the near-equilibrium formation of nitride and carbide precipitates, or at lower temperatures, in which case hardening occurs through the localized interatomic bonds that dissolved nitrogen and carbon establish with Fe, Cr, Ni atoms. For convenience, all three of these processes, i.e., carburization, nitriding, and nitrocarburization/carbonitriding, are collectively referred to in this disclosure as "low temperature surface hardening" or "low temperature surface hardening processes." For convenience, all of these processes will be considered as examples of "case formation."

Activation

As the temperatures involved in low-temperature surface hardening are so low, carbon and/or nitrogen atoms will not penetrate the native chromium-rich passivating oxide film of stainless steel within industrially relevant processing times. Therefore, low-temperature surface hardening of these metals is normally preceded by an activation ("depassivation") step in which the workpiece exposed to a halogen-containing gas, such as HF, HCl, $NF_3$, $F_2$, or $Cl_2$ at elevated temperature, e.g., 200 to 400° C. It is known that this treatment either removes the passivated film or, at least, makes it transparent to carbon and nitrogen.

WO 2006/136166 (U.S. Pat. No. 8,784,576) to Somers et al., the disclosure of which is incorporated herein by reference, describes a modified process for low-temperature carburization of stainless steel in which acetylene is used as the active ingredient in the carburizing gas, i.e. as the source compound for supplying the carbon atoms for the carburization process. As indicated there, a separate activation step with a halogen containing gas is unnecessary because the acetylene source compound is reactive enough to depassivate the steel as well. Thus, the carburization technology of this disclosure can be regarded as "self-" activating.

WO 2011/009463 (U.S. Pat. No. 8,845,823) to Christiansen et al., the disclosure of which is also incorporated herein by reference, describes a similar modified process for carbonitriding stainless steel, in which a reagent in the form of an oxygen-containing "N/C compound," such as urea, formamide, or similar is used as the source for nitrogen and carbon atoms needed for the carbonitriding process. Technology of this disclosure can also be self-activating because a separate activation step with a halogen containing gas may be unnecessary.

Surface Preparation and the Beilby Layer

Low-temperature surface hardening is often done on workpieces with complex shape. To develop these shapes, some type of metal shaping operation is usually required, such as a cutting step (e.g., sawing scraping, machining) and/or a wrought processing step (e.g., forging, drawing, bending, etc.). As a result of these steps, structural defects in the crystal structure as well as contaminants, such as lubricants, moisture, oxygen, etc., are often introduced into the near-surface region of the metal. In most workpieces of complex shape, there is normally created a highly defective sub-surface layer having a plastic-deformation-induced extra-fine grain structure and significant levels of contamination. This layer, which can be up to 2.5 μm thick, is known as the Beilby layer. After surface machining, the Beilby layer resides immediately below the passivating chromium-rich oxide film of stainless steels.

As indicated above, the traditional method for activating stainless steels for low-temperature surface hardening is by contact with a halogen-containing gas. These activating techniques are essentially unaffected by this Beilby layer.

However, the same cannot be said for the self-activating technologies described in the above-noted disclosures by Somers et al. and Christiansen et al., in which the workpieces are activated by contact with acetylene or an "N/C compound." Rather, experience has shown that, if a stainless steel workpiece of complex shape is not surface-treated by electropolishing, mechanical polishing, chemical etching or the like to remove its Beilby layer before surface hardening begins, the self-activating surface hardening technologies of these disclosures either do not work at all or, if they do work somewhat, produce cases that are at best spotty and inconsistent from surface region to surface region.

See, Ge et al., The Effect of Surface Finish on Low-Temperature Acetylene-Based Carburization of 316L Austenitic Stainless Steel, METALLURGICAL AND MATERIALS TRANSACTIONS B, Vol. 458, December 2014, pp 2338-2345, @2014 The Minerals, Metal & Materials Society and ASM International. As stated there, "[stainless] steel samples with inappropriate surface finishes, due for example to machining, cannot be successfully carburized by acetylene-based processes." See, in particular, FIG. 10(a) and the associated discussion on pages 2339 and 2343, which make clear that a "machining-induced distributed layer" (i.e., a Beilby layer) which has been intentionally introduced by etching and then scratching with a sharp blade cannot be activated and carburized with acetylene even though surrounding portions of the workpiece which have been etched but not scratched will readily activate and carburize. As a practical matter, therefore, these self-activating surface hardening technologies cannot be used on stainless steel workpieces of complex shape unless these workpieces are pretreated to remove their Beilby layers first.

To address this problem, U.S. Pat. No. 10,214,805 discloses a modified process for the low-temperature nitriding or carbonitriding of workpieces made from self-passivating metals in which the workpiece is contacted with the vapors produced by heating a reagent that is an oxygen-free nitrogen-halide salt. As described there, in addition to supplying the nitrogen and optionally carbon atoms needed for nitriding and carbonitriding, these vapors also are capable of activating the workpiece surfaces for these low-temperature surface hardening processes, even though these surfaces may carry a Beilby layer as a result of a previous metal-shaping operation. As a result, this self-activating surface hardening technology can be directly used on these workpieces, even though they define complex shapes due to previous metal-shaping operations and even though they have not been pretreated to remove their Beilby layers first.

Methods for Case Formation

As discussed above, most treatment methods apply reagent to the workpiece surfaces targeted for treatment via contact and/or placing the reagent in close proximity to the workpiece in a carefully regulated environment, typically with oxygen and other gases eliminated. Treatments involve heating over periods of time sufficient to result in pyrolysis of the reagent.

SUMMARY

Aspects of the disclosure include a method for low-temperature interstitial-solute case formation on a self-passivating metal workpiece, comprising exposing the workpiece in a heated gaseous environment comprising oxygen and comprising pyrolysis products of a nonpolymeric reagent, comprising nitrogen and carbon. Application of heat and reagent to the surface of a metal workpiece may induce case formation in an oxygen containing atmosphere.

The reagent may comprise at least one functionality selected from a guanidine, urea, imidazole, and methylammonium. The reagent may be associated with HCl or Cl. More generally, the reagent may be associated with a halide. The reagent may comprise at least one of Guanide HCl (GuHCl), biguanide, biguanide HCl (BgHCl), 1,1-dimethylbiguanide, 1,1-dimethylbiguanide HCl (DmbgHCl), melamine, melamine HCl, and mixtures thereof. Reagent may have non-guanidine additives, the additives including but not limited to: ammonium chloride, urea, melem, melam, imidazole, imidazole HCl, methylamine, methylammonium chloride, dicyandiamide, acetamidine, acetamidine HCl, ethylamine, ethylamine HCl, formamidine, formamidine HCl, and mixtures thereof.

At least a portion of the workpiece may comprise a cast, wrought, work hardened, precipitation hardened, partially annealed, fully annealed, formed, rolled, forged, machined, welded, stamped, additively manufactured, powder metal sintered, hot isostatic pressurized, and subtractively manufactured metal. It may be substantially free of heavy oxide scale and contamination. The case formation may comprise at least one of case hardening, case formation for corrosion resistance, and case formation for abrasion resistance. The case formation may result in change of at least one property selected from magnetic, electrical, thermodynamic, bioactive and mechanical as compared to a comparable workpiece that is identical except not subject to the exposing. The method may comprise maintaining a temperature of 700° C. or less during the exposing. It may comprise maintaining the temperature at about 450° C. or less during the exposing. Reagent reaction with metal workpiece may activate the metal surface. It may also cause interstitial infusion and diffusion of atomic hydrogen, carbon, and nitrogen into the surface of the metal. These effects may cause one or more of: case hardening, increased abrasion resistance, increased corrosion resistance, increased Youngs modulus, increased electrical resistance, decreases thermal conductivity, decreased hydrogen permeability, bioactive modifications and other surface of metal property modifications.

The exposing may be performed for a time period of 24 hours or less. The exposing may be performed for a time period of 8 hours or less. The exposing may be performed for a time period of 1 hour or less. At least a portion of the metal workpiece may comprise stainless steel (316L), 6-wt % Mo (6HN), Incoloy (825), Inconel (625), and Hastelloy (HC-22).

The method may comprise coating the reagent on at least a portion of the surface of the workpiece prior to the exposing. The case formation may result in a case layer on the workpiece at least about 1 μm thick. The case formation may result in a case layer on the workpiece at least about 14 μm thick.

BRIEF DESCRIPTION OF DRAWINGS

The attached FIGURE is a schematic illustrating a proposed atomic mechanism of alloy surface nitrocarburization.

DETAILED DESCRIPTION

Unless otherwise indicated herein, the term "case" or "case formation" will be used to describe a surface treated layer in metal with enhanced properties. Those enhanced properties may include hardness. They may also or alternatively include other enhanced properties as described herein.

Unless otherwise indicated herein, the terms "treatment" and "method" are used interchangeably to refer to the exposure of certain conditions, including but not limited to, heating and/or exposure to pyrolysis products of certain reagents, to a workpiece in a specified environment.

Overview and Discovery of New Surface Treatments

The applicants of the present disclosure discovered new surface treatments for case formation. They made these discoveries in the context of developing new surface treatments for the activation and/or hardening of metal workpieces. These new treatments form a case or surface layer with enhanced properties often including, but not limited to, hardness. They include exposing workpieces or articles to reagent and/or other chemicals to form the case.

The applicants discovered that treatments in environments containing oxygen can enhance case formation. They discovered that ambient oxygen may assist in case formation in certain types of steel under certain conditions, something previously unexpected. Accordingly, the treatments (method) of the present disclosure occur in the presence of oxygen. In particular, a method for low-temperature interstitial case formation on a self-passivating metal workpiece, as disclosed herein, comprises exposing the workpiece in a heated gaseous environment comprising oxygen to pyrolysis products of a nonpolymeric reagent comprising nitrogen and carbon. "Pyrolysis," is used generally herein to refer to thermal decomposition of a compound. As such, the methods disclosed herein relate to exposing the self-passivating workpiece to a thermally decomposed nonpolymeric reagent containing nitrogen and carbon. Applicants propose a theory to explain the chemical mechanism underlying this method. The theory is explained in the "Discussion and Interpretation" of the Examples section below.

Applicants discovered reagent induced case formation treatments of metal workpieces in accordance with the present disclosure may be accomplished in furnace enclosures with limited concern for air leaking into, or already present in, the enclosure. Concern about air leakage is generally lower here than with conventional gas-phase-induced low-temperature carburization (LTC), nitriding (LTN), or low-temperature nitrocarburization (LTNC) producing furnaces, because air leakage is sealed to prevent potential leak paths into the furnace. Successfully preventing leaks can avoid debilitation of hardened case depth formation. Reagent induced case formation treatments of metal workpieces, whether the workpieces originally are in contact with the reagent or not, can have little to no debilitation of case formation in an air environment (e.g., 11 vol % of air) in the furnace enclosure. Case formation treatments can also be conducted in ambulant or substantially unconfined environments, e.g., by locating reagents about the workpiece in an environment that facilitates fluid flow. In addition, ambulant environments for reagent treatment can include the reagent in gaseous form in the gas (e.g., air) about the workpiece. Enclosures and partial enclosures can accelerate gas transfer, including transfer of reagent gas. Heating can pyrolyze the reagent. The pyrolysis can consume much of the air or oxygen in the enclosure. This can enable case formation treatment in an otherwise oxygen and/or air containing gaseous environment. In other words, this setup can not only occur in the presence of air/oxygen, it can actually reduce air/oxygen in the vicinity of reagent.

Applicants also discovered that certain modified case formation treatments can be unexpectedly useful for imparting other properties to the materials than simply hardening. These other properties include electrical properties, magnetic properties, thermodynamic properties, bioactive properties, mechanical properties, chemical properties, corrosion resistance, abrasion resistance, increased Youngs modulus, increased electrical resistance, decreases thermal conductivity, decreased hydrogen permeability, bioactive modifications and other surface of metal property modifications. The applicants discovered that the treatments were valuable whether or not they were also used to form a substantially thick hardened layer on the material. They are valuable even when the treatment forms a case that is far thinner than those formed above in the context of traditional surface hardening methods.

In particular, the treatments were discovered in the context of rapid, low-temperature surface alteration of metallic materials to form a "case," as described below. As used herein, low-temperature case formation can refer to temperatures of 700° C. or less. It can also encompass 650° C. or less, 450° C. or less. It may refer to case formation in a range in temperature from 350° C. to 650° C. Rapid surface treatments can form cases in 24 hours or less, sometimes 8 hours or less, and sometimes 1 hour or less. The surface of the metal and reagent may be pre-heated or continually heated, to 700° C. or less, to 350° C. or less, or to 650° C. or less, by one or more of resistive, induction, conduction, convection, e-beam, and radiative means. In addition to heating the reagent to pyrolyze it, pyrolysis may also be induced via electromagnetic radiation. Other techniques that may be used to similar effect include, but are not limited to, application to the reagent of ultra violet (UV), visible, or infrared (IR) light. These treatments may be carried out during or just prior to case formation treatments of metal workpieces. As discussed above, the treatments may have substantial utility when applied in the presence of ambient, gaseous oxygen and other gases and elements. In some aspects, they actually consume ambient oxygen to practical effect.

Use of this Disclosure

Case Formation: General Aspects and Considerations

As used in this disclosure, the term "case" and the associated formation of the case or "case formation" refers to a treated surface of a solid material, typically a metal, that has different properties from the bulk because of the treatment. The different properties are discussed in more detail below. As such, that case on the workpiece, in accordance with the present disclosure, may exhibit improved hardness, corrosion resistance, and/or abrasion resistance as well as enhanced or improved magnetic, electrical, thermodynamic, bioactive and mechanical properties, as compared to an identical workpiece not subjected to the treatments that create the case.

The case may vary in thickness from less than 1 μm to thickness of 20 μm or more. It may be substantially 1 μm thick. In some instances, the case may be 14 μm thick or more. Alternatively, the case may be substantially 3-5 μm, 5-7 μm, 7-9 μm, 9-11 μm, 11-13 μm. 13-15 μm, 15-17 μm, 17-20 μm, 20-25 μm, and 25-30 μm thick.

Cases may be formed by any method described herein. These include, for example, exposing a metal surface to chemicals and/or coatings. The exposure can be physical and/or include chemical reactions. It can include chemisorption, adsorption, physisorption, surface ligand formation, agglomeration, etc. It can include diffusion of carbon and/or nitrogen into the material. Cases can be formed by the pyrolysis of materials and exposure to the product of the pyrolysis. Exposure to pyrolysis products may be conducted via gaseous or physical exposure of the surfaces of the solid material where the case is formed. The environment may be heated to facilitate case formation, e.g., through heated gaseous or heated physical exposure. Cases may be formed by coating the workpiece with reagent and/or altering the coating chemically, physically, or thermally. Cases may be formed by reagent-induced treatments of metal workpieces in furnace enclosures via direct reagent contact with the workpieces. These treatments may, for example, include the use of reagent coatings. Alternatively, treatments may be accomplished by convective conveyance of reagent pyrolysis products using ambient gases. The reagent pyrolysis products may condense onto the workpieces. The case can be formed by combining one or more of the methods, procedures, coatings, reagents, and chemicals described herein.

General Property Altering Treatments for Case Formation

Treatments disclosed herein may alter the properties, physical, chemical, electrical, thermodynamic, bioactive and/or magnetic of the workpiece surface, thereby forming a case on the workpiece. Treatments, including for example applying reagents disclosed herein, may activate the surface for any of the hardening processes disclosed herein. Treatments may block portions of the surface from applications of other treatments and/or exposure to liquid or gaseous species. One example is a metal (e.g., copper) treatment that prevents portions from exposure to, for example, vapors, such as those emanating from the pyrolysis of a chemical regent (e.g., any of the chemical regents disclosed, described, referenced, or implied herein). The workpiece surface may have one or more treatment types/compositions to apply different properties on different portions of the same workpiece.

Exemplary treatments can be applied to impart or increase hardness on a surface. Exemplary treatments can be applied to impart corrosion resistance on a surface. Exemplary treatments can be applied to impart abrasion resistance on a surface. Suitable treatments create a non-homogeneous top layer amalgam of iron or nickel-based alloy metal atoms. Some such treatments comprise one or more metallic phases, including at least one or more of austenite, martensite, and ferrite. Some such treatments contain one or more of interstitial carbon atoms, interstitial nitrogen atoms, dispersion of minute metal carbide precipitates, dispersion of minute metal carbide precipitates, dispersion of minute metal nitride precipitates, coarse metal carbide precipitates, and coarse metal nitride precipitates.

After a treatment is applied, a second treatment may use the portion of the workpiece affected by the first treatment to alter properties of the underlying workpiece. For example, a heat treatment may cause a reagent to activate the workpiece/workpiece for hardening processes, such as nitriding, carburizing, and nitrocarburizing in the hardening processes discussed and/or cited herein by reference. Heating the area affected by the first treatment may also result in the hardening process, e.g., where nitrogen and/or carbon released during treating diffuse into the surface of the workpiece to thereby harden the workpiece surface. Exposing the treated surface to a certain gas or reagent may result in case formation.

Hardening Treatments for Case Formation

One of the property altering treatments disclosed herein includes methods of hardening the workpiece. The present disclosure may facilitate and/or execute any hardening process described explicitly herein, and/or implied, or incorporated by reference. Such hardening processes include any that harden steel or alloys using nitrogen and/or carbon diffusion, particularly interstitial diffusion. These include conventional carburization, nitriding, carbonitriding, and nitrocarburization and low-temperature carburization, nitriding, carbonitriding, and nitrocarburization. They include hardening processes involving the use of reagents or other chemicals, as described herein. The reagents may activate the metal for hardening, for example by rendering a passivation layer such that it allows diffusion of nitrogen and/or carbon. Treatments disclosed herein may also be used in hardening processes that do not involve the diffusion of carbon or nitrogen (e.g., mechanical working techniques). Treatments described herein may be compatible with one or more of these hardening processes, wherein the processes are performed simultaneously and/or in concert. In some cases, processes described herein may also be used to prevent or deter hardening, and/or other physical and chemical processes, on certain portions of a workpiece.

More than one hardening treatment described herein may be performed. The hardening treatments may be applied simultaneously, sequentially, or alternately phased or pulsed regarding nitrogen and carbon introduction, for example. They may be applied in conjunction with any other treatment described herein, including the property altering treatments described above.

The hardening and/or property altering treatments may form a case or case-hardened outer layer. That layer may increase and/or improve at least one of hardness, corrosion resistance, and abrasion resistance. It may change other properties, including but not limited to, mechanical properties, elasticity, magnetic properties, thermodynamic properties, bioactive, properties, electrical properties, and mass density.

Treatment Conditions and Oxygen Content of Ambient Treatment Environment

Conventional case formation is conducted in a controlled gaseous environment containing majority nitrogen gas ($N_2$) and little ambient, molecular oxygen ($O_2$). There are a number of reasons for this. Treating in a low-oxygen environment (where the only oxygen contributed is from the reagent, and is not ambient or environmental oxygen) prevents or inhibits unwanted oxide formation on the workpiece, potentially leading to surface deactivation by (re-) formation of a passivating oxide film, and/or disabling reagent by oxidizing it. Unwanted oxide can slow or inhibit diffusion-based processes leading to case formation, particularly nitrogen and carbon diffusion critical to some methods of hardening. It seemed likely that uncontrolled reagent oxidation can cause some or all of the reagent's desirous chemical attributes (e.g., those facilitating activation) to be lost or rendered ineffective. For these and other reasons, case formation treatments of the prior art are done in $N_2$ environments in the absence of ambient oxygen.

Yet there is a clear practical advantage to performing these treatments in an oxygen-containing environment. Doing so opens the possibility to performing treatments in ambient air, which would dramatically simplify the treatments, conserve resources, and reduce expense. It would also more easily allow industrial scale-up and industrial level processing.

Reagent-induced case formation treatments of metal workpieces in air/oxygen-containing environments, can enable simplified post-operation treatments and reduced costs. In particular, air/oxygen presence in the furnace enclosure during a treatment run can consume more residual solid reagent pyrolysis products leaving less residue on enclosure walls post-treatment. This can cut down cleaning cost. Ambulant reagent-induced case formation treatments of metal workpiece structures may be accomplished via reagent-containing enclosures fastened about the workpiece. Such reagent can be heated, in situ, to effect case formation treatment. The treating environment may include structural supports or installations, e.g., systems that promote flid flow. Ambulant reagent induced case formation treatments may treat workpieces more effectively leading to increased workpiece structural strength, increased workpiece resistance to vibration fatigue failure, increased workpiece corrosion resistance. In addition, heating to pyrolyze gaseous reagent can reduce oxygen in the environment, allowing case formation treatment in the presence of oxygen and ambient air. As discussed above, this can increase the practicability of the process and lower cost.

The applicants have discovered certain case formation treatments that are apparently uninhibited by the presence of oxygen in the ambient environment. As discussed in more detail in the Examples section below, applicants have shown that oxygen does not inhibit case formation in at least 316L stainless steel under certain conditions. This result is unexpected given the effects of ambient oxygen on case formation discussed above. Moreover, applicants also show that oxygen presence actually may increase the thickness of cases formed in 6HN steel by up to 100% over the thickness formed in a pure $N_2$ environment.

Case formation discussed herein can be performed in an environment that is 0.005 oxygen to other gas by volume ratio. Alternatively, case formation disclosed herein can be performed in a gaseous environment that is 0.005-0.450 oxygen to other gas by volume, including 0.005-0.010 oxygen to other gas by volume, 0.010-0.020 oxygen to other gas by volume, 0.020-0.030 oxygen to other gas by volume, 0.030-0.040 oxygen to other gas by volume, 0.040-0.050 oxygen to other gas by volume, 0.050-0.055 oxygen to other gas by volume, 0.055-0.060 oxygen to other gas by volume, 0.060-0.070 oxygen to other gas by volume, 0.070-0.080 oxygen to other gas by volume, 0.080-0.090 oxygen to other gas by volume, 0.090-0.100 oxygen to other gas by volume, 0.100-0.150 oxygen to other gas by volume, 0.150-0.200 oxygen to other gas by volume, 0.200-0.210 oxygen to other gas by volume, 0.210-0.220 oxygen to other gas by volume, 0.220-0.230 oxygen to other gas by volume, 0.230-0.240 oxygen to other gas by volume, 0.240-0.250 oxygen to other gas by volume, 0.250-0.260 oxygen to other gas by volume, 0.260-0.270 oxygen to other gas by volume, 0.270-0.280 oxygen to other gas by volume, 0.280-0.290 oxygen to other gas by volume, 0.290-0.300 oxygen to other gas by volume, 0.300-0.310 oxygen to other gas by volume, 0.310-0.320 oxygen to other gas by volume, 0.320-0.330 oxygen to other gas by volume, 0.330-0.340 oxygen to other gas by volume, 0.340-0.350 oxygen to other gas by volume, 0.350-0.360 oxygen to other gas by volume, 0.360-0.370 oxygen to other gas by volume, 0.370-0.380 oxygen to other gas by volume, 0.380-0.390 oxygen to other gas by volume, 0.390-0.400 oxygen to other gas by volume, 0.400-0.410 oxygen to other gas by volume, 0.410-0.420 oxygen to other gas by volume, 0.420-0.430 oxygen to other gas by volume, 0.430-0.440 oxygen to other gas by volume, and 0.440-0.450 oxygen to other gas by volume.

Interstitial Surface Treatment and Fine Precipitates

In some instances, case formation disclosed herein involves the interstitial diffusion of an element (e.g., carbon or nitrogen) into the workpiece. Such interstitial diffusion may harden the workpiece as well as impart other property changes, as discussed above.

For example, certain variations show two case sublayers characteristic of low-temperature nitrocarburization. The outer sublayer is rich with interstitial nitrogen. The inner sublayer is rich with interstitial carbon. Hardness depth profiles show that the case depth represented by these two layers (e.g., 20-24 μm of a hardened case depth) after 2 hours of treatment with DmbgHCl and GuHCl is similar to the case depth achieved in a two-day treatment with more traditional methods and reagents.

In aspects of the present disclosure, the applicants discovered a way to harden stainless steel by forming a case with high concentrations of interstitial solute-carbon and nitrogen. Specifically, this case has outer zone rich in nitrogen and an inner zone (i.e., closer to the bulk of the steel) rich in carbon. Ideally, both zones are uniform, i.e. free of nitride- or carbide precipitates. However, even if precipitates form, this is not necessarily detrimental to the properties, neither to the mechanical properties, nor the corrosion resistance, as long as precipitates are dispersed sufficiently fine. In fact, if precipitation does occur, the conditions of high driving force for phase transformation combined with low mobility of the metal atoms at the low temperature of processing are likely to generate a fine, rather than a coarse, dispersion of particles. In particular, the processing temperatures are too low for the substitutional diffusion of chromium and other metal atoms necessary for coarse carbides to precipitate. In fact, as described in more detail above, avoiding deleterious coarse carbide and nitride precipitates is one of the reasons for performing hardening (surface engineering) under these conditions. Under these same conditions, overlapping concentrations of interstitial nitrogen and carbon are discouraged by the underlying physics, namely by the fact that nitrogen elevates the activity coefficient ("apparent concentration") of carbon. See, e.g., Xiaoting Gu et al., "Numerical Simulations of Carbon and Nitrogen Composition Depth Profiles in Nitrocarburized Austenitic Stainless Steels," Metal. and Mater. Transactions A, 45A, (2014), 4268-4279 (hereinafter, "Gu et al.") incorporated herein by reference. Gu et al. summarizes the thermodynamics behind the physical separating of concentrations of interstitial carbon and nitrogen occurring during low-temperature nitrocarburization. See, e.g., Gu et al. at 4268 (Abstract) and 4277. Therefore, Gu et al.'s work strongly suggests against overlapping concentrations of interstitial carbon and nitrogen. Id. However, Gu et al. leaves open the possibility of overlapping nitrogen and carbon concentrations where the elements are not purely interstitial, e.g., tied up in compounds such as nitride or carbide precipitates.

Materials science principles suggest that finely-dispersed carbide or nitride precipitates in 316SS can be expected to cause less loss of corrosion resistance compared to coarsely-dispersed carbide precipitates. One reason is the Gibbs-Thomson effect, which predicts that small particles leave a higher solute level in the matrix than large particles. Therefore, the matrix between small particles will retain higher levels of carbon or nitrogen than the matrix between large particles, maintaining better properties. Further, the reduced mean spacing between small precipitates compared to the mean spacing of large precipitates would have for the same precipitate volume fraction tends to make it harder for viscous liquid corrosive media (e.g. saltwater) to attack these small matrix regions. Finally, finely-dispersed precipitates are structurally more similar to the uniform distribution of carbon or nitrogen that constitutes the most desired state because of its excellent corrosion resistance. As properties like hardness and corrosion resistance will not abruptly change with increasing mean precipitate size, the structural proximity of a fine precipitate dispersion to a uniform distribution suggests that the properties will be similarly advantageous.

Products to Which Treatments of the Present Disclosure Can Be Applied

Treatments described herein can be applied to any of the materials disclosed that may be used to form workpieces or metal articles of manufacture. These include steels, especially stainless steels. Exemplary steels include 384SS, alloy 254, alloy 6HN, etc., as well as duplex alloys, e.g. 2205. The treatments may be applied to nickel alloys, nickel steel alloys, Hastelloy, nickel-based alloys. Exemplary nickel-based alloys include alloy 904L, alloy 20, alloy C276, etc. The treatments may also be applied to, cobalt-based alloys, manganese-based alloys and other alloys containing significant amounts of chromium, e.g. titanium-based alloys. However, they are not limited to such materials, and can apply to metals. In some variations, they may also be applied to non-metals.

More specifically, the stainless steels include those containing 5 to 50, preferably 10 to 40, wt. % Ni and enough chromium to form a protective layer of chromium oxide on the surface when the steel is exposed to air. That includes alloys with about 10% or more chromium. Some contain 10 to 40 wt. % Ni and 10 to 35 wt. % Cr. Examples include the AISI 300 series steels such as AISI 301, 303, 304, 309, 310, 316, 316L, 317, 317L, 321, 347, CF8M, CF3M, 254SMO, A286 stainless steels, and AL-6XN. The AISI 400 series stainless steels and Alloy 410, Alloy 416 and Alloy 440C are included. Cobalt-based alloys and high-manganese stainless steels may be included, particularly those with at least 10 wt. % Cr or a titanium. The surface of the metal may have a passivating coating, e.g., a continuous passivating coating, formed either from chromium-rich oxide or titanium-rich oxide. As a result of a metal shaping operation, the metal may have one or more distinct defect-rich subsurface zones (e.g., that constitute a Beilby layer). The metal may include, but is not limited to: 316L (UNS S31600), 6Mo (UNS S31254), 6HN (UNS N08367), Incoloy 825 (UNS N08825), Inconel 625 (UNS N06625), Hastelloys C22 (UNS N06022) or C276 (UNS N10276).

Other types of alloys that can be treated according to this disclosure are the nickel-based, cobalt based and manganese-based alloys, including those containing enough chromium to form a coherent protective chromium oxide protective coating when exposed to air, e.g., about 10% or more chromium. Examples of such nickel-based alloys include Alloy 600, Alloy 625, Alloy 825, Alloy C-22, Alloy C-276, Alloy 20 Cb and Alloy 718, to name a few. Examples of such cobalt-based alloys include MP35N and Biodur CMM. Examples of manganese containing alloys include AISI 201, AISI 203EZ and Biodur 108. Still other alloys treated according to this disclosure include titanium-based alloys. These alloys may form titanium oxide coatings upon exposure to air which inhibit the passage of nitrogen and carbon atoms. Specific examples of such titanium-based alloys include Grade 2, Grade 4 and Ti 6-4 (Grade 5). Alloys based on other self-passivating metals such as zinc, copper and aluminum can also benefit from treatments disclosed herein.

The treatments can be applied to metals of any phase structure including, but not limited to, austenite, ferrite, martensite, duplex metals (e.g., austenite/ferrite), etc.

It is to be understood that the treatments herein may be used with worked materials, as described above. The workpieces may be at least one of a cast, wrought, work hardened, precipitation hardened, partially annealed, fully annealed, formed, rolled, forged, machined, welded, additively manufactured, powder metal sintered, hot isostatic pressed, and stamped. They may also be applied to materials that are not worked. Workpieces within this disclosure may or may not include a Bielby layer. They may be work hardened, and/or precipitation hardened. Further, they may be formed, rolled, forged, machined, or subtractively manufactured. They may be substantially free of heavy oxide scale and contamination.

This disclosure can be carried out on any metal or metal alloy which is self-passivating in the sense of forming a coherent protective chromium-rich oxide layer upon exposure to air which is impervious to the passage of nitrogen and carbon atoms. The metal workpieces may alternatively not be self-passivating. These metals and alloys are described for example in patents that are directed to low-temperature surface hardening processes, examples of which include U.S. Pat. Nos. 5,792,282, 6,093,303, 6,547,888, EPO 0787817 and Japanese Patent Document 9-14019 (Kokai 9-268364). Treatments of this disclosure can also be applied to materials that do not form passivation layers.

Treatments described herein can be applied not only to wrought metal alloys, but also to workpieces or articles created by other techniques include additive manufacturing (AM) and 3D printing. Such workpieces or articles may be sintered via laser (e.g., by selective laser sintering (SLS)), for example. These workpieces or articles may be additive manufactured in whole or in part. They may also be hot isostatic pressurized, formed, rolled, forged, machined, or subtractive manufactured.

Exemplary Reagents Used in Treatments of the Present Disclosure

As discussed above, the workpiece can be exposed to pyrolysis products of a nonpolymeric reagent comprising carbon and nitrogen. As such, treatments of the present disclosure may include exposing surfaces to a class of non-polymeric N/C/H compounds. Examples of suitable such reagents include a guanidine [$HNC(NH_2)_2$] and/or melamine [$C_3H_6N_6$] moiety or functionality with or without an HCl association (e.g., complexing) for case formation. The guanidine and/or melamine moiety may or may not have a halide association. These reagents result in a case formation on the workpiece and improve hardening, corrosion resistance, and/or abrasion resistance.

In particular, results show that at least three reagents belonging to this system, 1,1-dimethylbiguanide HCl (hereinafter, "DmbgHCl"):

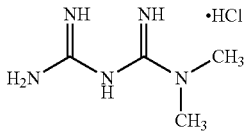

and guanidine HCl (hereinafter, "GuHCl"):

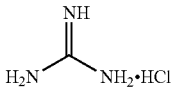

and biguanide HCl (BgHCl) have successfully induced extremely rapid surface hardening, and other surface property enhancements, under low-temperature conditions. The guanidine [$HNC(NH_2)_2$] moiety or functionality with HCl complexing is the chemical structure common to both DmbgHCl, GuHCl, and BgHCl. Reagents include guanidine, guanidine HCl, biguanide, biguanide HCl, 1,1-dimethylbiguanide, 1,1-dimethylbiguanide HCl, melamine, melamine HCl (MeHCl), and combinations thereof.

Other compounds including guanidine with HCl are also suitable, e.g., methylammonium Cl, may provide similar results. Other guanidine containing compounds that might achieve similar results in this context include triguanides (the basic structure of triguanides is:

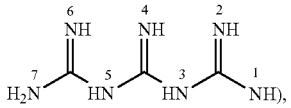

such as carbamimidoylimidodicarbonimidic diamide HCl.

Examples of guanides, biguanides, biguanidines and triguanides that produce similar results include chlorhexidine and chlorohexidine salts, analogs and derivatives, such as chlorhexidine acetate, chlorhexidine gluconate and chlorhexidine hydrochloride, picloxydine, alexidine and polihexanide. Other examples of guanides, biguanides, biguanidines and triguanides that can be used according to the present invention are chlorproguanil hydrochloride, proguanil hydrochloride (currently used as antimalarial agents), metformin hydrochloride, phenformin and buformin hydrochloride (currently used as antidiabetic agents). An important criterion may be whether the reagent or mix of reagent (s) has a liquid phase while decomposing in the temperature ranges of low-temperature nitrocarburization (e.g., 450 to 500° C.). The extent to which reagents evaporate without decomposing before reaching that temperature range is an important consideration.

As discussed above, guanidine and/or melamine moiety reagents may or may not be complexed with HCl. Reagent complexing with any hydrogen halide may achieve similar results. Guanidine and/or melamine moiety reagents without HCl complexing may also be mixed with other reagent additives, such as the reagents discussed in U.S. patent Ser. No. 17/112,076, herein incorporated by reference in its entirety, with and without Cl and HCl association. They may comprise at least one functionality selected from a urea, imidazole, and methylammonium.

Reagent additives used in the treatments disclosed herein include those comprising non-polymeric N/C/H compounds. Mixtures of different non-polymeric N/C/H compounds are included. The non-polymeric N/C/H compounds may supply nitrogen and carbon atoms for case formation, including simultaneous surface hardening, e.g., carburization, nitriding, and/or carbonitriding of the workpiece. Mixtures of these compounds can be used to tailor that the particular non-polymeric N/C/H compounds used to the particular operating conditions desired for simultaneous surface hardening. The non-polymeric N/C/H compounds may be used for any surface alteration including hardening and altering any other surface property alteration described herein. List of reagent additives includes but is not limited to: ammonium chloride, urea, melem, melam, imidazole, imidazole HCl, methylamine, methylammonium chloride, dicyandiamide, acetamidine, acetamidine HCl, ethylamine, ethylamine HCl, formamidine, formamidine HCl, and mixtures thereof.

The non-polymeric N/C/H compounds that may be used as reagent or reagent additives in treatments disclosed herein can be a compound which (a) contains at least one carbon atom, (b) contains at least one nitrogen atom, (c) contains only carbon, nitrogen, hydrogen and optionally halogen atoms, (d) is solid or liquid at room temperature (25° C.) and atmospheric pressure, and (e) has a molecular weight of ≤5,000 Daltons. Non-polymeric N/C/H compounds with molecular weights of ≤2,000 Daltons. ≤1,000 Daltons or even ≤500 Daltons are included. Non-polymeric N/C/H compounds which contain a total of 4-50 C+N atoms, 5-50 C+N atoms, 6-30 C+N atoms, 6-25 C+N atoms, 6-20 C+N atoms, 6-15 C+N atoms, and even 6-12 C+N atoms, are included.

Specific classes of non-polymeric N/C/H compounds that can be used as reagent additives with the disclosed treatments include primary amines, secondary amines, tertiary amines, azo compounds, heterocyclic compounds, ammonium compounds, azides and nitriles. Of these, those which contain 4-50 C+N atoms are desirable. Those which contain 4-50 C+N atoms, alternating C═N bonds and one or more primary amine groups are included. Examples include, aminobenzimidazole, adenine, benzimidazole, pyrazole, cyanamide, dicyandiamide, imidazole, 2,4-diamino-6-phenyl-1,3,5-triazine (benzoguanamine), 6-methyl-1,3,5-triazine-2,4-diamine (acetoguanamine). 3-amino-5,6-dimethyl-1,2,4-triazine, 3-amino-1,2,4-triazine, 2-(aminomethyl)pyridine, 4-(aminomethyl)pyridine, 2-amino-6-methylpyridine and 1H-1,2,3-triazolo (4,5-b)pyridine, 1,10-phenanthroline, 2,2'-bipyridyl and (2-(2-pyridyl)benzimidazole).

Also included are the three triazine isomers, as well as various aromatic primary amines containing 4-50 C+N atoms such as 4-methylbenzeneamine (p-toluidine), 2-methylaniline (o-toluidine), 3-methylaniline (m-toluidine), 2-aminobiphenyl, 3-aminobiphenyl, 4-aminobiphenyl, 1-naphthylamine, 2-naphthylamine, 2-aminoimidazole, and 5-aminoimidazole-4-carbonitrile. Also included are aromatic diamines containing 4-50 C+N atoms such as 4,4'-methylene-bis(2-methylaniline), benzidine, 4,4'-diaminodiphenylmethane, 1,5-diaminonaphthalene, 1,8-diaminonaphthalene, and 2,3-diaminonaphthalene. Hexamethylenetetramine, benzotriazole and ethylene diamine are also included.

Any reagent or reagent additive described herein may be associated with HCl. HCl, in some cases, may assist in de-passivation or other chemical process. In some cases, HCl association may increase the reagent phase change temperatures.

Yet another included class of reagent compounds, in which some of the above compounds are included, are those which form nitrogen-based chelating ligands, e.g., guanidine moieties and polydentate ligands containing two or more nitrogen atoms arranged to form separate coordinate bonds with a single central metal atom. Compounds forming bidentate chelating ligands of this type are included. Examples include o-phenantrolin, 2,2'-bipyridine, aminobenzimidazol and guanidinium chloride. In addition to $[HNC(NH_2)_2]$, guanidine moieties can be more generally represented with $[R—(H_2NC═NH)]$. Urea moieties with $[R—NH(H_2NC═O)]$ are included.

Still another included type of reagent compounds are those used to produce carbon nitrides and/or carbon nitride intermediate(s) described in WO 2016/027042, the disclosure of which is incorporated herein in its entirety. The intermediate species may participate in or contribute to low-temperature activation and hardening of a workpiece. Precursors, which can include melamine and GuHCl, can form various carbon nitride species. These species, which have the empirical formula $C_3N_4$, comprises stacked layers or sheets one atom thick, which layers are formed from carbon nitride in which there are three carbon atoms for every four nitrogen atoms. Solids containing as little as 3 such layers and as many as 1000 or more layers are possible. Although carbon nitrides are made with no other elements being present, doping with other elements is contemplated.

Yet another included subgroup of non-polymeric N/C/H compounds included are those which contain 20 or less C+N atoms and at least 2 N atoms.

In some instances, at least 2 of the N atoms in these compounds are not primary amines connected to a 6-carbon aromatic ring, either directly or through an intermediate aliphatic moiety. In other words, although one or more of the N atoms in these particular non-polymeric N/C/H compounds can be primary amines connected to a 6-carbon aromatic ring, at least two of the N atoms in these compound should be in a different form, e.g., a secondary or tertiary amine or a primary amine connected to something other than a 6-carbon aromatic ring.

The N atoms in the non-polymeric N/C/H compounds of this subgroup (i.e., non-polymeric N/C/H compounds containing 20 or less C+N atoms and at least 2 N atoms) can be connected to one another such as occurs in an azole moiety, but more commonly will be connected to one another by means of one or more intermediate carbon atoms. Urea may also be included.

Of the non-polymeric N/C/H compounds of this subgroup, those which contain 15 or less C+N atoms, as well as those which contain at least 3 N atoms are included. Those that contain 15 or less C+N atoms and at least 3 N atoms are included.

The non-polymeric N/C/H compounds of this subgroup can be regarded as having a relatively high degree of nitrogen substitution. In this context, a relatively high degree of nitrogen substitution will be regarded as meaning the N/C atomic ratio of the compound is at least 0.2. Compounds with N/C atomic ratios of 0.33 or more, 0.5 or more, 0.66 or more, 1 or more, 1.33 or more, or even 2 or more are included. Non-polymeric N/C/H compounds with N/C atom ratios of 0.25-4, 0.3-3, 0.33-2, and even 0.5-1.33 are included.

Non-polymeric N/C/H compounds of this subgroup containing 10 or less C+N atoms are included, especially those in which the N/C atomic ratio is 0.33-2, and even 0.5-1.33.

Non-polymeric N/C/H compounds of this subgroup which contain 8 or less C+N atoms are included, especially those in which the N/C atomic ratio is 0.5-2 or even 0.66-1.5, in particular triguanide-based reagents.

In order to achieve this relatively high degree of nitrogen substitution, the non-polymeric N/C/H compounds of this subgroup can include one or more nitrogen-rich moieties examples of which include imine moieties [C═NR], cyano moieties [—CN] and azo moieties [R—N═N—R]. These moieties can be a part of a 5- or 6-membered heterocyclic ring containing one or more additional N atoms such as occurs when an imine moiety forms a part of an imidazole or triazine group or when an azole moiety forms a part of a triazine or triazole group.

These moieties can also be independent in the sense of not being part of a larger heterocyclic group. If so, two or more of these moieties can be connected to one another through an intermediate C and/or N atom such as occurs, for example, when multiple imine moieties are connected to one another by an intermediate N atom such as occurs in 1,1-dimethylbiguanide hydrochloride or when a cyano group is connected to an imine moiety through an intermediate N atom such as occurs in 2-cyanoguanidine. Alternatively, they can simply be pendant from the remainder of the molecule such as occurs in 5-aminoimidazole-4-carbonitrile or they can be directly attached to a primary amine such as occurs in 1,1-dimethylbiguanide hydrochloride, formamidine hydrochloride, acetamidine hydrochloride, 2-cyanoguanidine, cyanamide and cyanoguanidine monohydrochloride.

In the non-polymeric N/C/H compounds that contain one or more secondary amines, the secondary amine can be part of a heterocyclic ring containing an additional 0, 1 or 2 N atoms. An example of such compounds in which the secondary amine is part of a heterocyclic ring containing no additional N atoms is 1-(4-piperidyl)-1H-1,2,3-benzotriazole hydrochloride. Examples of such compounds in which the heterocyclic ring contains one additional N atom are 2-aminobenzimidazole, 2-aminomethyl benzimidazole dihydrochloride, imidazole hydrochloride and 5-aminoimidazole-4-carbonitrile. An example of such compounds in which the secondary amine is part of a heterocyclic ring containing two additional N atoms is benzotriazole. Alternatively, the secondary amine can be connected to a cyano moiety such as occurs in 2-cyanoguanidine and cyanoguanidine monohydrochloride.

In the non-polymeric N/C/H compounds of this subgroup which contain one or more tertiary amines, the tertiary amine can be part of a heterocyclic ring containing an additional 1 or 2 N atoms, an example of which is 1-(4-piperidyl)-1H-1,2,3-benzotriazole hydrochloride.

In some variations, the non-polymeric N/C/H compound used will contain only N, C and H atoms. The particular non-polymeric N/C/H compound used will be halogen-free. In other aspects of the present disclosure, the non-polymeric N/C/H compound can contain or be associated or complexed with one or more optional halogen atoms.

One way this can be done is by including a hydrohalide acid such as HCl in the compound in the form of an association or complex. If so, this non-polymeric N/C/H compounds is referred to in this disclosure as being "complexed." On the other hand, if the non-polymeric N/C/H compound has not been complexed with such an acid, then it is referred to in this disclosure as being "uncomplexed." In those instances in which neither "complexed" nor "uncomplexed" is used, it will be understood that the term in question refers to both complexed and uncomplexed non-polymeric N/C/H compounds.

The non-polymeric N/C/H compounds of the present disclosure can be complexed with a suitable hydrohalide acid such as HCl and the like (e.g., HF, HBr and HI), if desired. In this context, "complexing" will be understood to mean the type of association that occurs when a simple hydrohalide acid such as HCl is combined with a nitrogen-rich organic compound such as 2-aminobenzimidazole. Although the HCl may dissociate when both are dissolved in water, the 2-aminobenzimidazole does not. In addition, when the water evaporates, the solid obtained is composed of a mixture of these individual compounds on an atomic basis—e.g., a complex. It is not composed exclusively of a salt in which Cl-anions from the HCl are ionically bound to N atoms in the 2-amionbenzimidazole which N atoms have been made positive by taking up H+ cations derived from the HCl.

Any suitable form of any reagent described herein may be used with this disclosure. This includes, powder, liquid, gas and combinations thereof. As used herein, "reagents" includes any substance, including a non-polymeric N/C/H compound or other compounds used in the altering of metal surface properties and/or case formation. Reagent may be applied as a powder, liquid, or vapor. Reagent may be applied as a coating.

Coatings Application in Treatments for Case Formation

In accordance with the present disclosure, coatings may be used in connection with the treatment of the workpieces of the present disclosure. Coatings may be applied to the materials discussed above and in the references cited herein, and by any method described below. For example, coatings may be applied to various metals, including various steels (e.g., stainless steels such as 316SS) and nickel steel alloys. They may be applied before or during a hardening and/or heating process. The coatings may be applied selectively to specific portions of the workpiece surface (e.g., flange, ferrule sharp-edge, needle valve stem tip, ball valve orifice rim, etc.) to be subjected to a specific treatment facilitated by the coating (e.g., hardening). In other words, the coating may be applied to at least a portion of the surface of the workpiece for selective treatment of that portion of the surface of the workpiece. In addition, reagents described above in the context of case formation treatments may be coated prior to being enclosed in the treatment enclosure. Workpieces that may facilitate such treatment include, but are not limited to, pre-swaged conduit or tubing ends, conduit or tube fitting port connectors, machined or formed conduit or tubing ends on valve or fitting bodies, conduit or pipe flared or flanged ends, sections of conduit, tubing or pipe, be they straights or elbows.

In certain aspects, the coatings may contain reagent and are applied to at least a portion of the surface of the workpiece so as to harden that portion of the surface or as to form an interstitial case in that portion for corrosion resistance, abrasion resistance, changes in magnetic, electrical, thermodynamic, bioactive, or mechanical properties. In other aspects of the present disclosure, the coating does not contain reagent and instead masks the surface to block treatment, e.g., heat treatment and/or surface hardening on that portion. In aspects, the coatings are applied in constant volume processing, such as the constant volume processing hardening processes described herein. In aspects, they are applied via closed or clamped openings. In aspects, the coatings are applied in a modified atmosphere to, for example, enhance coatings (e.g., pressurized or vacuum environments) and/or prevent contamination. In aspects, they are applied in reactive environments, such as in an $NH_3$ as described in U.S. Provisional Patent Application No. 63/017,273. In aspects, the coatings include other chemicals to facilitate or carry reagent (e.g., urea with or without HCl associated).

Coatings may be applied at temperatures below the temperature at which the reagent in the coating starts to decompose or change its chemical characteristics. The coatings may alternatively be applied when their reagents are in a molten state. They can be applied by spray, e.g., atomized spray. Coatings may be applied electrostatically or by fluidized bed. They may additionally or alternatively be applied by centrifugal force, and/or spin coating. The coatings may be applied to flat or non-flat surfaces, and/or to particular aspects or portions of surfaces. They may be applied selectively to certain surfaces or certain portions of a surface.

Once applied, the coatings may be dried. The drying may remove the vehicle (i.e., any chemical or substance that supports and/or conveys the reagent, such as a solvent, powder, paste, spray, dip, and colloid) or other workpieces from the coating. The vehicle removal process (e.g., heating) may be performed at a temperature below the temperature of decomposition of the reagent. Subsequent to drying and/or a vehicle removal process, the workpiece with the dried coating may be heated for processing. For example, the workpiece may be heated to a temperature sufficient to decompose the reagent in the coating to provide carbon and/or nitrogen for a hardening process as described herein and in any document incorporated herein by reference. Drying may be accomplished via vacuum, desiccant exposure, or by other suitable means.

In some aspects of the present disclosure, coatings may be applied to facilitate case formation. The coatings may be applied directly to the workpieces (e.g., coatings including activating reagent). They may facilitate the hardening processes discussed above and in the references cited herein.

In some instances, the coating's reagent may also or alternatively facilitate heat treatments to portions of the surface of the workpiece. Coatings may include various components in addition to the reagent, e.g., a "vehicle" as defined above to facilitate coating application, wetting, and/or adherence to the workpiece surface.

The coatings may chemically alter the surface of a workpiece. For example, they may activate the surface for penetration of carbon or nitrogen through any of the methods discussed herein (e.g., carburization, nitriding, nitrocarburization, and carbonitriding) or incorporated by reference. They may perform other chemical reactions on the surface of the workpiece that impart a chemical on that surface, remove a chemical from the surface, and/or change the surface chemistry in some other way.

Coating materials disclosed herein may be optimized for certain applications. One example is to facilitate dispersion and application of a specific reagent disclosed herein. Chemical or physical aspects of coatings may be altered depending on factors such as the specific reagent used, the material to be coated, and the processing (e.g., hardening or heating) to be facilitated by the coating. Chemical and physical properties of the coatings disclosed herein may be altered for similar reasons. These alterations, whether explicitly described herein or not, should be considered as part of the instant disclosure.

Coating materials may also be designed, formulated, and/or applied to coat specific portions of a workpiece's surface. For example, coatings may include solvent mixes containing appropriate stoichiometric or volumetric amounts of reagent to coat particular areas of the workpiece's surface. Coating properties can be tuned to selectively coat portions of the workpiece's surface (e.g., finished valve-product media contacting passages). Coatings properties that may be engineered within the context of this disclosure include coating rheology, viscosity, reagent solubility, pH, wettability, drying behavior, wet and/or dry film thickness, adhesion to the parts, cleanability after treatment, or with additives to affect reagent transformation, reagent decomposition mechanisms, reagent interaction with the coated parts.

Exemplary Coating Types for Case Formation Treatments

Exemplary coating types are discussed below. It should be understood that these coating types are not mutually exclusive. Some coatings may include aspects of two or more types.

Coatings Including Metal

Some coatings may contain one or more metallic phases, including at least one or more of austenite, martensite, and ferrite. These coatings may also contain the reagents, vehicles, and additives described herein. Some coatings may contain metal additives that may be pre-infused with one or more of interstitial carbon atoms, interstitial nitrogen atoms, dispersion of minute metal carbide precipitates, dispersion of minute metal nitride precipitates, coarse metal carbide precipitates, and coarse metal nitride precipitates. The metal additives can assist with the surface hardening (surface engineering) process. The metal additives may control or modify the reagent action (surface reactions, pyrolysis mechanisms, catalysis of certain reactions, etc.) with the coated surface. Certain additives may act as seed crystals which drive certain reactions over others in the interstitial case formation in the workpiece. Any type of coating listed below may include metal.

Liquid- or Molten-Reagent Type Coatings

Reagent may be applied to the alloy surface by means of a liquified or molten reagent that may include, for example, any of the vehicles, reagents, and additives described herein. These coatings may comprise a reagent heated above its melting point. Parts may be immersed, sprayed, or otherwise covered with the non-solid reagent coating. Additives may be added to modify properties including melting temperature, viscosity, wettability, and decomposition pathways.

Powder Type Coatings

Coatings may be powder like, comprising other materials (e.g., vehicles or wetting agents) interspersed with reagent powder. Powder coatings may include any of the vehicles, reagents, or additives described herein. Coating processes include surface pre-treatments to modify surfaces to improve wetting, adhesion, and effectiveness of subsequent treatment processes.

For example, the coating may include metal catalyst (e.g., 316SS or other alloy metal powder) mixed with the reagent. In some instances, including such a metal catalyst with the reagent, the catalyst improves reagent reactivity. The other materials in the coatings may be chemically bonded or complexed with the reagent, or not (e.g., physically mixed with reagent). An exemplary powder type coating comprises polymer and reagent. Exemplary polymers include staged, non-reacted monomers (e.g., melamine). Exemplary coatings include "a staged" monomer (e.g., melamine) prior to "b stage" compounding with additional thermosetting reactants. The reagent powder may be associated with other compounds (e.g., HCl). Powder coatings may also lack reagents.

A powder coating may be sufficiently mechanically durable to adhere to and/or protect workpiece surfaces for extended time periods (e.g., minutes, hours, or days) between coating and treatment (e.g., hardening and/or heating). Appropriate powder size selection and distributions can be obtained by grinding and subsequent sieving operations to product desired flowable mixes and may include flow or anti-caking additives of appropriate particle sizes to avoid clumping and ensure good flow and processability.

Specific, non-limiting examples of powder type coatings in addition to the above that may be used include polyolefin and polypropylene among others. Powders may include polymer and reagent, for example.

Water Based Coatings

Water based coatings may include reagent. The water itself may act as a vehicle for the reagent. The water may further include other vehicles for the reagent. The water based coating may be of a suspension or emulsion-type water-based solution. Water based coatings may include any of the vehicles, reagents, or additives described herein.

Suitable examples of vehicles include surfactants and polypropylene oxide, polyethylene oxide, and polyvinyl acetate among others. Examples of a suitable vehicle include, but are not limited to, non-ionic surfactants including polyethylene oxide, polypropylene oxide, among others. The chemical identities of vehicle and reagent, as well as the stoichiometric ratio of vehicle to reagent (or other components of the coating), may be individually or simultaneously tailored to coat reagent on the workpiece's surface. This may include tailoring for a particular workpiece surface chemistry or morphology. For example, it may be desired to coat difficult to reach and/or obstructed workpiece surfaces (e.g., inner surfaces and/or surfaces that face obstructions). It may be desired to coat complicated workpiece shapes or surfaces, including select portions of those surfaces. Water based coatings in liquid form may be applied via pressurization and/or flushing through the workpiece, especially when coating workpiece inner surfaces. For example, the pressurizing and/or flushing processes may be especially useful for coating media contacting surfaces in finished valve products. Some water-based coatings may be applied by dip coating the workpiece in the coating liquid, by spray, or by condensation.

Once applied, a water-based coating may be air or gas dried. Drying may remove the vehicle in the coating, leaving primarily, essentially, or exclusively reagent. Alternatively, the vehicle and reagent remain in the coating, leaving primarily, essentially, or exclusively vehicle and reagent. Drying may be accomplished by conventional blowing means, e.g., blow drying with or without heating the gas stream. The gas(es) may include air, inert gases, or other types of gases. Drying may also be accomplished via vacuum to cause outgassing (e.g., evaporation, or de-solvating) of certain parts of the coating, for example the vehicle. The vacuum treatment may include heating the coating and/or workpiece to temperatures below the decomposition temperature of the coating reagent, e.g., 180 to 200° C. Traps for particular chemical components may assist this process and may be included in the vacuum and/or oven system(s). Fungicide and bacteria controls may also included in the drying process. Outgassing may be monitored to a particular stage (e.g., complete outgassing of coating vehicle) via vacuum gauge or pressure gauges.

Specific, non-limiting examples of water-based coatings that may be used include coatings based on polyethylene oxide and polypropylene oxide and mixtures thereof.

Deposition-Based or Gas-Deposited Coatings

Deposition-based or gas-deposited coatings may include any of the vehicles, reagents, and additives described herein. Reagent material may be applied to the surface of the workpiece by deposition methods including, but not limited to, PVD and CVD processes. The reagent may be carried by a vehicle chemical species and deposited onto the part surface. Additives to the vehicle or the reagent material may modify a coating and process properties including adhesion, wettability, reagent volatilization and decomposition behavior. Such processes may occur at a variety of temperatures and pressures to achieve the desired coating thickness, location specificity, coating morphology, and coating composition.

Coatings may be deposited via gas also simply by settling of the gas constituents on the workpiece. In other words, no particular chemical or mechanical deposition event is required. The coating may simply accumulate on the surface of the workpiece as a film.

Non-Water Solvent Based Coatings

Various solvents, solvent blends, or other modifiers to tailor rheological properties and enhance processability may also be included in the coatings (powder, liquid, paste, gel, etc.) disclosed herein. Suitable vehicles include solvents. Coatings may also include solvent mixes that can be removed via appropriate process conditions conducing to drying/evaporation while depositing a coating of reagents on the surface. Vehicles can include viscosity and surface-active agents to facilitate the coating application and adhesion/wetting to the surface, as well as the suspension of the reagent in the coating vehicle.

Solvent based coatings can be applied and off-gassed/dried in a similar method. Alcohol and alcohol solvent mixes with appropriate solubility, viscosity and distillation points are examples of suitable solvent mixes. Similar mixtures exist in fluxing operations during printed wiring board and other electronic manufacturing processes. Such processes are typically dried under a nitrogen blanket. Such coatings may or may not contain a vehicle that lends itself to a cohesive dry coating which encapsulates or suspends the chemical reactants. This vehicle upon heating may leave the system into the gas phase, leaving the desired reagent chemicals behind. The temperature of vehicle vaporization may be above the solvent drying temperature, but below the temperature at which the reagent interacts with the metal surface causing activation and/or surface hardening. Drying may also be accomplished by heating the coated workpiece. Vehicles can include viscosity and surface-active agents to facilitate the coating application and adhesion/wetting to the surface, as well as the suspension of the reagent in the coating vehicle.

Solvent mixes containing appropriate stoichiometric or volumetric amounts of reagent may be used to coat some workpieces. They can selectively coat finished valve-product media contacting passages or hardened tooling, for example. This process may have some similarities to flux applications for electronic components.

Examples of solvents include, but are not limited to, organic solvents. Non-limiting specific examples of such organic solvents include toluene, acetone, methylamine, chloroform, acetonitrile, isopropanol, ethanol, dioxane, dimethylsulfoxone, hexane, aniline, glycerol. They also include solvent mixes, of any of the solvents described herein. The solvent mixes can be removed via appropriate process conditions conducing to drying/evaporation while depositing an coating of reagents on the surface.

Oil-Based Coatings

Oil, including for example, mineral oil, finely distilled oil, and/or food-grade oil, may be used as a vehicle to coat workpiece surfaces with reagent. The oil may include a dispersion of reagent with a concentration or volume fraction tailored for specific applications (e.g., as discussed above in the context of water-based coatings). The oil may also include HCl associated or complexed with reagent in stoichiometric ratio or volume fraction tailored for particular applications. The oil may also include a dispersing agent to help disperse the reagent and/or HCl. The foregoing reagent and/or HCl mixtures may be used to provide, for example, a room temperature coating.

Oil-based coatings, once applied, may be dried and/or outgassed in a similar manner as water-based coatings described above. The oil-based coatings may include any of the vehicles, reagents, and additives described herein.

For example, a vacuum oven outfitted with a roughing pump and cleanable traps for chemical components may be heated to remove the mineral oil. The heating may be to a temperature that is substantially below the decomposition temperature of the reagent. The heating temperature may be chosen based on the oil properties. For example, if the oil is a mineral oil, the heating temperature may be chosen based on the distillate temperature profile of the mineral oil. The oil may be recycled after removal from the coating. Additional distillation or filtration of the recycled oil can improve its purity. The distillation or filtration may be applied during oil removal or as a separate, standalone process, depending on the level of oil contamination.

In an exemplary configuration, machining oils coating a workpiece such as ferrules in a machine working center include reagents. Finished and machined workpieces leave a machine working center wet with the oil including the reagents. The oil-wet workpieces can then be placed in a furnace. The high temperature of the furnace could evaporate the oils leaving a reagent coating on the workpieces. The base oil can be removed aid of vacuum heating to reduce drying times. If vacuum systems are used, the base oil can be recovered and recycled making it more cost effective. If, on the other hand, the oil is not fully evaporated, an oil composition would preferably be chosen that would not interfere with activation and/or hardening reactions. The reagent coating, whether including residual oil or not, could subsequently be used to facilitate activation and/or hardening of the workpiece, as disclosed above.

Both hydrocarbon or emulsion (water based) machining oils can accommodate additives such as the reagents disclosed herein. In fact, such oils typically already contain additives for various purposes, including extending machine tool life, reduce bacterial and fungal blooms, and extending oil life. Reagent, as disclosed herein, can also be added. Hydrocarbon based machine oils can be preferable for more demanding applications, such as those in which the finished machined article/workpiece is complex.

Specific, non-limiting examples of oil-based coatings that may be used, in addition to the above, include finely distilled paraffinic mineral oils, other paraffinic oils, other mineral oils, synthetic oils, various petroleum products, motor oils, plant-based oils, other food-grade oils, hydrocarbon based oils, emulsion based oils, and machining oils for workpieces, among others. Related to oil-based coatings, coatings may also or alternatively include a petroleum distillate. These include mineral oil, naphtha, heavy fuel oil, and waxes. The distillate may be treated as with other vehicles described herein (e.g., evaporated to leave reagent).

EXAMPLES

A new process was tried that reproducibly generated a nitrogen- and carbon-rich case. Moreover, the case formed under exposure to air was found to be unaffected, even improved, by the presence of ambient oxygen. The process was tried on ferrules of two different stainless steel alloys: (1) SAE 316L grade stainless steel (316L) (UNS: S31603) and (2) 6HN stainless steel (UNS: N08367). Each ferrule had a 0.0625 inch tube size.

Preparation and Experimental Details

All runs were repeated in two different environments, one containing $N_2$ gas (comparative) and another in an oxygen-containing atmosphere. The comparative $N_2$ atmosphere had an $N_2$ purge flow rate of 50 ml/min. $N_2$ runs also included an $N_2$ protective flow of 20 ml/min around the simultaneous thermal analysis (STA) balance, used to measure mass fraction during the experiment as described below. The protective flow joins the purge flow below the furnace. In the runs with the oxygen-containing gas, the purge included dry compressed air flow at 10 ml/min. These runs also include an additional $N_2$ purge flow of 40 ml/min and a 20 ml/min protective flow of $N_2$ around the STA.

Before the start of each run, the STA system was evacuated and purged with $N_2$ three times. After the final $N_2$ refill, the system paused to equilibrate for about 30 minutes before heating. The heating profiles were as follows. First, the furnace ramped from 35° C. to a set temperature of 450° C. at a rate of 25° C./minute. Second, the furnace held the 450° C. temperature for 8 hours. Third, the furnace cooled back down to 35° C. at a rate of 20° C./minute. Gas flows, as described above, were constant throughout the heating profile.

Correction runs were performed for each method with the specified furnace atmosphere. During the correction runs all crucibles were empty. The correction run helped improve accuracy of thermogravimetric analysis (TGA) and differential scanning calorimetry (DSC) analysis of the sample runs. Correction runs included the full heating profile described below for each sample run.

The alloy samples were clean non-treated 1/16 inch ferrules of either 316L or 6HN. All eight alloy ferrules were individually placed into $Al_2O_3$ crucibles with lids along with the designated mass and reagent. A comparable mass of the same alloy was placed into a reference crucible having no reagent. The workpiece was applied to the coating as a functional equivalent to the coating being applied to the workpiece. Two different reagents types were used: (1) pure GuHCl (guanidine hydrochloride) and (2) GuHCl formed into a paste with glycerol. The paste had a mass fraction of 0.84 GuHCl and 0.16 glycerol. Sample crucibles were loaded with reagent to achieve a nominal 8 mg of GuHCl.

During treatment, STA recorded mass data throughout the heating profile. It also recorded residual reagent mass fraction at the end of each profile. After treatment, the alloy samples were mounted, polished, and etched for optical microscopy. The 316L samples were etched with Marbles etchant. The A16HN samples were etched with Kane's etchant.

Example 1

The treatment or case depth for each sample, measured via optical microscopy, appears in Table 1 below.

TABLE 1

Case depth for each alloy and reagent.

| Reagent | Atmosphere | Alloy | Case Depth ± Standard Dev. (μm) |
|---|---|---|---|
| GuHCl powder | $N_2$ | 316L | 21 ± 1 |
| GuHCl powder | oxygen containing | 316L | 20 ± 2 |
| GuHCl powder | $N_2$ | 6HN | 12 ± 1 |
| GuHCl powder | oxygen containing | 6HN | 20 ± 3 |
| GuHCl/Glycerol Paste | $N_2$ | 316L | 20 ± 2 |
| GuHCl/Glycerol Paste | oxygen containing | 316L | 20 ± 2 |
| GuHCl/Glycerol Paste | $N_2$ | 6HN | 10 ± 1 |
| GuHCl/Glycerol Paste | oxygen containing | 6HN | 13 ± 3 |

The 6HN samples show a large difference in case formation when GuHCl powder is used in an $N_2$ (comparative) environment and when the same powder is used in an oxygen-containing environment. Specifically, Table 1 shows that the case depth in the presence of oxygen is nearly twice (20 μm) the value in $N_2$ (12 μm). 6HN also shows a large increase in case depth (~35%) when the GuHCl is delivered by glycerol paste in an oxygen containing environment vs.

in $N_2$ gas. The 316L sample seems to create a case depth of around 20 μm whether in $N_2$ or oxygen-containing gas and whether GuHCL is applied in powder or glycerol paste form.

One of the main differences between the 6HN and 316L alloys is their nickel content. 6HN has a higher nickel content making it generally more difficult to form thick cases under these conditions. Applicants have observed the higher the nickel content (316L-6HN-825-625) the thinner the case formation. Therefore, the improvement in case depth with oxygen content of the environment for 6HN shown in Table 1 indicates a considerable technological advantage.

Table 2 shows the mass fraction (unitless) of residual reagent left over on the sample as measured by STA at the end of each run.

TABLE 2

Residual mass fraction of reagent.

| Reagent | Atmosphere | Alloy | Average Residual Mass Fraction (End of Run) |
|---|---|---|---|
| GuHCl powder | $N_2$ | 316L | 0.35 ± 0.02 |
| GuHCl powder | oxygen containing | 316L | 0.18 ± 0.01 |
| GuHCl powder | $N_2$ | 6HN | 0.30 ± 0.02 |
| GuHCl powder | oxygen containing | 6HN | 0.10 ± 0.02 |
| GuHCl/Glycerol Paste | $N_2$ | 316L | 0.15 ± 0.01 |
| GuHCl/Glycerol Paste | oxygen containing | 316L | 0.10 ± 0.02 |
| GuHCl/Glycerol Paste | $N_2$ | 6HN | 0.08 ± 0.03 |
| GuHCl/Glycerol Paste | oxygen containing | 6HN | 0.04 ± 0.01 |

Table 2 shows that the presence of oxygen during the treatment appears to leave less residual reagent at the end of the experiment. In the case of 316L, the mass fraction of residual was 50% lower in the oxygen-containing environment for GuHCl powder and 30% lower in the case of the GuHCl/Glycerol paste. In the case of 6HN (powder), it was about 68% lower for GuHCl powder and 56% lower for the paste. This provides the technical and processing advantage in the sense that less reagent residue needs removal after the treatment if performed in an oxygen containing environment.

Table 2 shows that the least amount of residual occurs when 6HN is treated in an oxygen containing environment. This is significant because Table 1 shows that treating 6HN in an oxygen containing environment has a dramatic effect (doubling) on the case depth. Together with the fact that 20 μm case depths are especially difficult to form in 6HN, these results suggest higher and more effective reagent utilization when treating 6HN in the presence of oxygen.

Discussion and Interpretation

Based on the results shown above in Tables 1 and 2, the applicants expect similar treatment effects on other alloys. Not ruling out the potential existence of other valid theories, the applicants offer the following hypothesis to consistently explain the experimental observations described above regarding the role and impact of the reagents and resulting gases.

An explanation for how the presence of air or the oxygen in air may expedite or similarly advantage low temperature interstitial case formation comprises the following: (1) Guanidinate moiety reagent pyrolysis on metal produces monatomic hydrogen; (2) Monatomic hydrogen with the presence of oxygen produces water; (3) HCl associated guanidinate moiety reagent with water enhances metal depassivation; and (4) Enhanced metal depassivation helps expedite low temperature interstitial case formation.

By including GuHCl, each of the reagents used in the above experiment presumably adds a considerable amount of chlorine to the environment. This chlorine may enable surface activation (e.g., removal of the initial passivating oxide film and exposure of a bare alloy surface). It may further result in the GuHCl presenting guanidinate ligands to the metal surfaces for catalytic adsorption. Guanidinate ligand metal-philic catalysis is described in an exhaustive review of publications on this subject by F. T. Edelmann, Recent Progress in the Chemistry of Metal Amidinates & Guanidinates: Syntheses, Catalysis and Materials, 2013. Both chelating and bridging coordination modes of catalytic adsorption may be expected. Chelating is a type of bonding of molecules to a metal surface forming two or more coordinate bonds between the ligand and a single metal atom.

Guanidinate ligands are metal-philic, anionic N—C—N molecules that have claw-like structures (See F. T. Edelmann, "Chapter Two-Recent Progress in the Chemistry of Metal Amidinates and Guanidinates: Syntheses, Catalysis and Materials," Advances in Organometallic Chemistry v61 (2013) at page 2 (Scheme 2.1) and page 4 (Scheme 2.2), herein incorporated by reference in its entirety) with a resonant double bond across the N—C—N claw. Metal surface adsorption of guanidinate ligands in the above-described systems is presumably enabled by dissociation of GuHCl. This likely occurs during pyrolysis of the GuHCl and related interactions of urea near and in contact with the metal surface. Adsorption releases the remaining atoms in GuHCl to the metal surface. These remaining atoms include atomic hydrogen, nitrogen, and carbon. Consequently, the metal surface builds up chemical potentials and activities of these elements, providing a driving force for diffusion of hydrogen, nitrogen, and carbon into the surface of the alloy to create the case.

In this metal facilitated catalytic absorption, metal atoms undergo chemical reactions with reagents, but are not themselves consumed in the reactions forming chemical intermediaries. These species facilitate carbon, nitrogen, and hydrogen infusion into the alloy through the surface. Thus, the alloy surface may catalytically produce the elemental ingredients for its own nitrocarburization.

The guanidinate ligands may elevate the activity coefficients and chemical potentials at the same concentration of carbon and nitrogen above those deposited on the metal surface in their absence (e.g., above the chemical potentials of carbon and nitrogen during conventional, non-rapid low-temperature nitrocarburization). Nitrogen and carbon activity elevation by guanidinate ligands may also explain observed rapid diffusion of hydrogen, nitrogen, and carbon atoms when released by pyrolysis of GuHCl or urea.

Monatomic hydrogen and chlorine may assist with maintaining surface activation despite oxygen in the ambient atmosphere. Monoatomic hydrogen may even account for much of the initial surface activation. Applicants note that much of the HCl is scrubbed by the abundant $NH_3$ generation during reagent pyrolysis. Hydrogen presence is known to increase the rate of carbon diffusion in silicon. Correspondingly, hydrogen may increase the diffusivity of carbon or nitrogen within the alloys considered here. Hydrogen may lower the energy barrier associated with atomic jumps of carbon and nitrogen by saturating the bonds of metal atoms that would normally lock in carbon and nitrogen in their interstitial crystal structure sites. Of the three elemental constituents carbon, nitrogen, and hydrogen, hydrogen atoms diffuse most rapidly owing to their small size.

Diatomic oxygen is a strong inhibitor of free radical reactions, as its forward rate constant is orders of magnitude higher than the forward polymerization reaction rate. If free radicals are formed during the catalytic reaction of the metal and GuHCl, that reaction should consume oxygen faster than all others reactions in the system. This fast oxygen consumption may leave little or no oxygen to form oxide at the metal surface. In that case, there should be a stoichiometric relationship between chemical intermediaries (e.g., free radicals) and the oxygen level. Adsorption of guanidinate ligands and/or the reaction products of their formation may block out oxygen from reaching the alloy surface, further stabilizing the bare alloy surface activation even in the presence of significant oxygen activity in the ambient.

The above observations and analysis seem consistent with observations with other ligand-forming reagents. In particular, applicants have observed these other reagents to enable rapid low-temperature nitrocarburization, DmbgHCl (1,1-Dimethylbiguanide HCl) and BgHCl (biguanide HCl), can likewise present guanidinate metal-philic catalytic ligands as described above. Experiments provide evidence that urea combined with GuHCl participates in rapid low-temperature carburization in 316L. The N—C—N structure on urea is similar to the other noted reagents, but the molecule includes pendant O bonds.

The attached FIGURE is a schematic illustrating a proposed atomic mechanism of alloy surface nitrocarburization with these considerations in mind. Initially, in stage 1, as shown in the FIGURE, the surface 100*a* of an alloy 100 surface is covered by a native Cr-rich oxide film 120 with a thickness 120*a* of about 1 nm. This is due to the presence of oxygen in the ambient environment 200. At stage 2, the surface 100*a* is exposed to molecules like GuHCl 130 and urea 140 introduced into environment 200, for example, by pyrolysis of reagents described herein. Cl in the reagents removes the oxide 120 by reacting with Cr to form $CrCl_2$ 150. This exposes the bare alloy surface 120*b*. In stage 3, pyrolysis products of e.g. GuHCl 130 include stable metal-philic N—C—N ligands 160, shaped like claws, adsorb to the bare alloy surface 120*b*. The formation of these ligands 160 releases single hydrogen, nitrogen, and carbon atoms to the metal surface shown in designation 170. Hydrogen, nitrogen, and carbon build up corresponding chemical potential and activity that drives diffusion of these atoms into the alloy 100. Dissolved in the alloy, hydrogen, nitrogen, and carbon atoms reside in interstitial sites (e.g., 170*a*, 170*b*, and 170*c*), between the metal atoms (Fe, Cr, Ni). Enabled by their small ionic radius, the hydrogen atoms diffuse in most rapidly. Carbon and nitrogen diffuse into the alloy 100 less rapidly. However, hydrogen saturates the metal bonds that, absent hydrogen, would bond carbon or nitrogen atoms. Therefore, an abundance of hydrogen in the alloy ahead of carbon and nitrogen increases the mobility of carbon and nitrogen, enabling more rapid transport of the latter (Stage 4). For an atom species diffusing into an alloy, Fick's Laws suggest that the highest concentration will result directly below the surface. This is true for nitrogen, as shown in Stages 3 and 4. However, here the physical driving force of diffusion is not only a gradient in concentration, as suggested by Fick's Laws. A chemical potential gradient is also driving diffusion. More specifically, as the presence of nitrogen elevates the activity coefficient ("visibility") of carbon, i.e. its chemical potential for a given concentration, the maximum carbon concentration forms at a certain depth 180 below the surface, where the nitrogen concentration is lower than near the surface. The phenomenon that a negative gradient in chemical potential implies positive gradient in concentration is known and sometimes denoted as "up-hill" diffusion.

The above observations suggest metal surface treatments using the reagents described in oxygen-containing would not be inhibited and may, in some instances, actually be enhanced. In particular, rapid low-temperature nitrocarburization enabling reagents, amidinate, or guanidinate metal-philic catalytic ligand inducing reagents may be applied to metal surfaces by any means described herein (e.g., by coating, painting, depositing, etc.). After application, both metal and reagents may be heated to bring about case formation. The case will likely form in the metal underneath the applied reagents.

The reagents may be applied to the entire surface of a metal work piece or on selected surfaces of the work piece. They may be placed near the metal work piece or near selected surfaces of the work piece. As an example, reagent may be placed on the outside of pipe bends or in the conduits of valves, fittings, or manifolds to selectively treat these workpieces. Heating the metal and reagents may be accomplished by any suitable means, including thermal induction, conduction, or convection. Workpieces that may facilitate such treatment include but are not limited to, pre-swaged conduit or tubing ends, conduit or tube fitting port connectors, machined or formed conduit or tubing ends on valve or fitting bodies, conduit or pipe flared or flanged ends, sections of conduit, tubing or pipe, be they straights or elbows.

In some instances, it has been found that vapors produced by heating and/or pyrolyzing a reagent comprising a non-polymeric N/C/H compound, either complexed with a hydrohalide or not complexed with a hydrohalide, to vaporous form readily activates the surface of self-passivating metals notwithstanding the presence of a significant Beilby layer. In addition, these vapors supply nitrogen and carbon atoms for the simultaneous surface hardening of the workpiece.

Although not wishing to be bound to any theory, we believe that, in some instances (e.g., those with non-polymeric N/C/H compounds as reagent additives), vapors of the non-polymeric N/C/H compound decompose by heating and/or pyrolysis either prior to and/or as a result of contact with the workpiece surfaces to yield ionic and/or free-radical decomposition species, which effectively activate the workpiece surfaces. In addition, this decomposition also yields nitrogen and carbon atoms which diffuse into the workpiece surfaces thereby hardening them through low-temperature carbonitriding.

Additional Examples

Several additional experiments were carried out to test the utilization of reagent and post-treatment residue. Reagents were induced in furnaces, as described above. Reagent was largely added either in gaseous form, or via a coating.

Example 2

Eight samples each of 316L, 6HN, 625 alloys were introduced into a furnace. 0.75 $mg/mm^2$ coating of GuHCl reagent was added to each workpiece surface. The furnace was then held at 500° C. for 3 hours. Minimal gas flow (e.g., approximately 1 furnace turnover per hour) was allowed through the furnace during heating. Samples were then cooled to ambient temperature and examined for their case depth and hardening.

Results showed hardening under these conditions in the presence of oxygen yielded no debilitating effect on case depth. Specifically, case depths achieved in an environment with 11% by volume air (i.e., 2.2% by volume oxygen) was essentially the same as the same experiment run in a pure nitrogen environment.

Example 3

The furnace runs in Example 2 were all repeated for eight samples of the same 316L, 6HN, 625 alloys. This time reagent was not applied as a coating. Instead, the same GuHCl reagent was placed in the furnace in the vicinity of the workpiece samples in powder form. The powdered reagent was in the vicinity of, but not touching the work piece samples.

The results were similar to those of Example 2. Case depths achieved in each sample under in 11% air/2.2% oxygen were again essentially the same as the same experiment run under a pure nitrogen environment.

Example 4

Each of Examples 2 and 3 was repeated with the GuHCl reagent replaced by BgHCl reagent. Again, case depths achieved in 11% air/2.2% oxygen were essentially the same as the same experiment run under a pure nitrogen environment.

Example 5

Examples were run with the same environment described above (11% air/2.2% oxygen in an otherwise nitrogen environment) and GuHCl reagent coating with eight samples of the same 316L, 6HN, 625 alloys to determine reagent use efficiency. Reagent usage efficiency was assumed to be inversely correlated to an amount of reagent present on the walls of the reaction vessel after each run.

The following reactor runs were performed both in 11% air/2.2% oxygen and in a pure nitrogen gas environment: (a) 500° C. for 0.5 hours, 0.25 mg/mm$^2$ reagent; (b) 500° C. for 3 hours, 0.75 mg/mm$^2$ reagent; and (c) 450° C. for 8 hours, 0.75 mg/mm$^2$ reagent. These experiments showed that the runs in 11% air/2.2% oxygen resulted in less residual reagent on the reactor walls than runs in the pure nitrogen environment. This suggests more efficient use of reagent when oxygen is present during the case formation process.

In run (b) described above, the residual reagent amount on the walls of the reactor was measured and compared with the residual reagent amount during a run in a pure nitrogen environment. The results showed that the run when oxygen was present consumed more reagent than the run under nitrogen only conditions. Specifically, the residual reagent under case formation conditions was ⅓ of the measured residual reagent in nitrogen only.

Example 6

In this Example, a structure of metal foils of alloy 316L and reagent was formed. The foils were shaped in curve manner to represent the shape of a conduit. A layer of GuHCl reagent was placed on top of the foil. Then another layer of 316L alloy foil was placed on top of the coating layer, forming a 316L alloy foil/reagent/316L alloy foil sandwich. The sandwich structure was then made convex in order to represent a conduit shape.

The sandwiches were heated 460° C. for 8 hours. The reagent exposed foil surfaces exhibited a 3 to 8 μm \case depth, split between the inner and outer layers of a typical case depth formation.

Example 7

Each of Examples 2-6 above were repeated using DmbgHCl (1,1-Dimethylbiguanide HCl) reagent. Results showed no statistical differences in case depth in treated workpieces made from 316L, 6HN, and 625 alloys in an 11% air/2.2% oxygen environment and in a pure nitrogen environment.

The terminology as set forth herein is for description of the variations of the present disclosure only and should not be construed as limiting the disclosure as a whole. All references to singular characteristics or limitations of the present disclosure shall include the corresponding plural characteristic or limitation, and vice versa, unless otherwise specified or clearly implied to the contrary by the context in which the reference is made. Unless otherwise specified, "a," "an," "the," and "at least one" are used interchangeably. Furthermore, as used in the description and the appended claims, the singular forms "a," "an," and "the" are inclusive of their plural forms, unless the context clearly indicates otherwise.

To the extent that the term "includes" or "including" is used in the description or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. Furthermore, when the phrase "one or more of A and B" is employed it is intended to mean "only A, only B, or both A and B." Similarly, when the phrases "at least one of A, B, and C" or "at least one of A, B, C, and combinations thereof" are employed, they are intended to mean "only A, only B, only C, or any combination of A, B, and C" (e.g., A and B; B and C; A and C; A, B, and C). Ranges as used herein are intended to include every number and subset of numbers within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

Any combination of method or process steps as used herein may be performed in any order, unless otherwise specified or clearly implied to the contrary by the context in which the referenced combination is made.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A method for low-temperature interstitial case formation on a self-passivating metal workpiece comprising exposing the workpiece in a heated gaseous environment comprising atmospheric oxygen to pyrolysis products of a nonpolymeric reagent comprising at least nitrogen and carbon.

2. The method of claim 1, wherein the reagent comprises at least one functionality selected from a guanidine or melamine, and wherein pyrolyzing the nonpolymeric reagent in the gaseous environment comprising oxygen reduces residual reagent from an amount of residual reagent produced by pyrolyzing the nonpolymeric reagent in a gaseous environment that does not comprise oxygen.

3. The method of claim 1, wherein the reagent is associated with HCl or Cl.

4. The method of claim 1, wherein the reagent comprises at least one of guanidine, guanidine HCl, biguanide, biguanide HCl, 1,1-dimethylbiguanide, 1,1-dimethylbiguanide HCl, melamine, melamine HCl, and combinations thereof.

5. The method of claim 1, wherein at least a portion of the workpiece comprises a cast, wrought, work hardened, precipitation hardened, partially annealed, fully annealed, formed, rolled, forged, machined, welded, stamped, additive manufactured, powder metal sintered, hot isostatic pressurized, and subtractive manufactured metal.

6. The method of claim 1, wherein the case formation comprises at least one of case hardening, case formation for corrosion resistance, and case formation for abrasion resistance.

7. The method of claim 1, wherein the case formation results in change in at least one property selected from magnetic, electrical, thermodynamic, bioactive, and mechanical properties as compared to a comparable workpiece that is identical except not subject to the exposing.

8. The method of claim 1, further comprising maintaining a temperature of 700° C. or less during the exposing.

9. The method of claim 1, further comprising maintaining the temperature at about 450° C. or less during the exposing.

10. The method of claim 1, wherein the exposing is performed for a time period of 24 hours or less.

11. The method of claim 1, wherein the exposing is performed for a time period of 8 hours or less.

12. The method of claim 1, wherein the exposing is performed for a time period of 1 hour or less.

13. The method of claim 1, wherein at least a portion of the metal workpiece comprises stainless steel including at least 2 wt. % Mo.

14. The method of claim 13, wherein the stainless steel comprises at least 6 wt. % Mo.

15. The method of claim 1, further comprising coating the reagent on at least a portion of the surface of the workpiece prior to the exposing.

16. The method of claim 1, wherein the case formation results in a case layer on the workpiece at least about 1 μm thick.

17. The method of claim 1, wherein the case formation results in a case layer on the workpiece at least about 14 μm thick.

18. A method for low-temperature interstitial case formation on a self-passivating metal workpiece comprising exposing the workpiece in a heated gaseous environment comprising atmospheric oxygen to pyrolysis products of at least one ligand-forming reagent.

19. The method of claim 18, wherein the reagent comprises at least one functionality selected from a guanidine, urea, imidazole, and methylammonium.

20. The method of claim 18, wherein the reagent is associated with HCl or Cl.

21. The method of claim 18, wherein the reagent comprises at least one of guanidine HCl, biguanide HCl, dimethylbiguanide HCl, methylammonium Cl, and combinations thereof.

* * * * *